US009200342B2

(12) United States Patent
Yokoi et al.

(10) Patent No.: US 9,200,342 B2
(45) Date of Patent: Dec. 1, 2015

(54) HOT-ROLLED STEEL SHEET AND MANUFACTURING METHOD THEREOF

(75) Inventors: Tatsuo Yokoi, Tokyo (JP); Hiroshi Abe, Tokyo (JP); Osamu Yoshida, Tokyo (JP); Yasuhiro Miyatani, Tokyo (JP); Shinichi Araki, Tokyo (JP); Osamu Kawano, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 13/807,042

(22) PCT Filed: Jun. 30, 2011

(86) PCT No.: PCT/JP2011/065014

§ 371 (c)(1),
(2), (4) Date: Dec. 27, 2012

(87) PCT Pub. No.: WO2012/002481

PCT Pub. Date: Jan. 5, 2012

(65) Prior Publication Data

US 2013/0092295 A1 Apr. 18, 2013

(30) Foreign Application Priority Data

Jun. 30, 2010 (JP) ..... 2010-149702

(51) Int. Cl.
*C21D 8/00* (2006.01)
*C21D 8/02* (2006.01)
(Continued)

(52) U.S. Cl.
CPC *C21D 8/005* (2013.01); *C21D 8/02* (2013.01); *C21D 8/0226* (2013.01);
(Continued)

(58) Field of Classification Search
CPC ..... C21D 8/005; C22C 38/04
USPC ..... 148/504, 608
IPC ..... C22C 38/04
See application file for complete search history.

(56) References Cited

U.S. PATENT DOCUMENTS 7,501,030 B2 3/2009 Nakata et al.
2005/0183798 A1 8/2005 Kobayashi et al.
(Continued)

FOREIGN PATENT DOCUMENTS

EP 1462535 9/2004
EP 1568792 8/2005
(Continued)

OTHER PUBLICATIONS

International Preliminary Report on Patentability dated Feb. 21, 2013 issued in corresponding PCT Application No. PCT/JP2011/065014.
(Continued)

*Primary Examiner* — Weiping Zhu
(74) *Attorney, Agent, or Firm* — Kenyon & Kenyon LLP

(57) ABSTRACT

A hot-rolled steel sheet according to the present invention is a steel sheet containing a predetermined components, and satisfying O<S/Ca<0.8, N−14/48×Ti≥"0" (zero) %. It is a high-strength hot-rolled steel sheet for a spiral pipe excellent in low-temperature toughness in which a pro-eutectoid ferrite fraction is 3% or more and 20% or less, and the other is a low-temperature transformation phase in a microstructure at a depth of a half thickness of a sheet thickness from a steel sheet surface, a number average crystal grain size of a whole of the microstructure is 2.5 μm or less, an area average grain size is 9 μm or less, a standard deviation of the area average grain size is 2.3 μm or less, and a reflected X-ray intensity ratio {211}/{111} in a direction and in a {111} direction relative to a plane in parallel to the steel sheet surface at the depth of the half thickness of the sheet thickness from the steel sheet surface is 1.1 or more. The steel sheet has both high-toughness and strength of API5L-X80 standard or more.

5 Claims, 8 Drawing Sheets

(51) Int. Cl.

| | |
|---|---|
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C21D 8/10*** | (2006.01) |
| ***C21D 9/46*** | (2006.01) |
| ***C22C 38/06*** | (2006.01) |

(52) U.S. Cl.

CPC ..... *C21D 8/0263* (2013.01); *C21D 8/10* (2013.01); *C21D 9/08* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01)

(56) References Cited

U.S. PATENT DOCUMENTS

| | | | | |
|---|---|---|---|---|
| 2010/0059149 | A1 | 3/2010 | Yokoi et al. | |
| 2010/0084054 | A1* | 4/2010 | Yokoi et al. ..... | 148/504 |
| 2011/0079328 | A1 | 4/2011 | Yokoi et al. | |
| 2011/0126944 | A1 | 6/2011 | Kami et al. | |

FOREIGN PATENT DOCUMENTS

| | | |
|---|---|---|
| EP | 2116624 | 11/2009 |
| JP | 2004-315957 | 11/2004 |
| JP | 2005-281838 | 10/2005 |
| JP | 2006-274338 | 10/2006 |
| JP | 3846729 | 11/2006 |
| JP | 2008-240151 | 10/2008 |
| JP | 2008-248384 | 10/2008 |
| JP | 2010-037567 | 2/2010 |
| WO | 03/025241 | 3/2003 |
| WO | 2009/145328 | 12/2009 |

OTHER PUBLICATIONS

International Search Report dated Sep. 20, 2011, issued in corresponding PCT Application No. PCT/JP2011/065014.

Nippon Steel Technical Report, No. 380, 2004, pp. 70-75, and a partial English translation thereof.

European Search Report dated Feb. 21, 2014 issued in corresponding EP Application No. 11800943.0.

Yukito Hagiwara and Shiro Miyamoto, "Fracture Mechanics Approach to Evaluate the Effect of Thickness on Fracture Toughness in Heavy Sectioned Steel" The Iron and Steel, vol. 69 (1983), No. 6, pp. 647-654.

* cited by examiner

PATTERN 1 (A DELAY BEFORE R3 ROLLING)

PATTERN 2 (A DELAY BEFORE R2 1st PASS ROLLING WITH R4 ROLLING)

PATTERN 3 (A DELAY BEFORE R2 1st PASS ROLLING)

PATTERN 4
(A DELAY BEFORE R2 3rd PASS ROLLING WITH HOT BAR THICKNESS 50mm)

HOT-ROLLED STEEL SHEET AND MANUFACTURING METHOD THEREOF

This application is a national stage application of International Application No. PCT/JP2011/065014, filed Jun. 30, 2011, which claims priority to Japanese Application No. 2010-149702, filed Jun. 30, 2010, the content of which is incorporated by reference herein in its entirety.

TECHNICAL FIELD

The present invention relates to a high-strength hot-rolled steel sheet for a spiral linepipe excellent in low temperature toughness, and a manufacturing method thereof.

BACKGROUND ART

In recent years, development areas of energy resources such as crude oil, natural gas progress to areas of which natural environment is more severe like cold districts such as North Sea, Siberia, North America, Sakhalin, and deep oceans such as North Sea, Gulf of Mexico, Black Sea, Mediterranean Sea, Indian Ocean. Besides, a natural gas development increases from a point of view of a global environmental consideration, and at the same time, high-pressurizing of operating pressure is required from a point of view of economical efficiency of a pipeline system. Properties required for a linepipe corresponding to changes of these environmental conditions become more and more upgrading and diversified. They can be roughly classified into (a) requirement for thickening/high-strengthen, (b) requirement for high-toughness, (c) requirement for low carbon equivalent (Ceq) in accordance with improvement in field weldability, (d) requirement for high-severity of corrosion resistance, (e) requirement for high deformation properties at a frozen ground, an earthquake fault area. Besides, these properties are generally required in a composite manner in accordance with a usage environment thereof.

Further, development at a distant place, an area in severe natural environment which are left as it is from a point of view of profitability, begins to fully start on the back of recent increasing demand of the crude oil and the natural gas. In particular, the high-toughness capable of being used at the cold district in addition to the thickening, the high-strength to improve transport efficiency are strongly required for a linepipe used for a pipeline in which the crude oil and the natural gas are transported for a long distance, and it is a technical problem to enable both of these required properties.

CITATION LIST

Patent Literature

Patent Literature 1: Japanese Patent No. 3846729 (Japanese National Publication of International Patent Application No. 2005-503483)

Patent Literature 2: Japanese Laid-open Patent Publication No. 2004-315957

Patent Literature 3: Japanese Laid-open Patent Publication No. 2008-240151

Patent Literature 4: Japanese Laid-open Patent Publication No. 2005-281838

Non-Patent Literature

Non-Patent Literature 1: Nippon Steel Technical Report No. 380 2004, Page 70

SUMMARY OF INVENTION

Technical Problem

A ductile fracture rate (SA) in a DWTT (Drop Weight Tear Test) test evaluating a propagation stopping property of brittle fracture which is incorporated into specifications as an index of a low-temperature toughness by each project is a value measured in accordance with API standard, and the value is generally known to decrease as the thickness and the strength increase. In particular, a stress state at a tip of a test piece notch transits from a plane stress to a plane strain and a degree of triaxial stress is increased as a sheet thickness increases, and when the sheet thickness exceeds 16 mm, an effect thereof becomes further remarkable. It is known that it is effective to strengthen a controlled rolling, namely, to increase a rolling reduction ratio at a non-recrystallization region temperature in austenite as a means to improve the SA.

High impact absorption energy is required from a point of view of preventing ductile fracture which progresses when an internal pressure is high and a propagation speed of cracks becomes faster than a speed of a reduced pressure wave after blow-out such as a steel pipe for natural gas pipeline. Occurrence of separation improves the SA in appearance, but it lowers the absorption energy, and therefore, it is not preferable. The separation is a portion of an opening in parallel to a sheet surface observed at a fracture surface. Besides, customers who incorporate "without separation" into the specifications tend to increase. Accordingly, it is a technical trend to satisfy marketing needs to enable both the improvement of the SA and the suppression of the separation.

On the other hand, steel pipes for linepipe are classified into a seamless steel pipe, an UOE steel pipe, an electric resistance welded steel pipe, and a spiral steel pipe depending on a manufacturing process thereof, and they are selected according to usage, size, and so on. All of the above except the seamless steel pipe have characteristics in which a plate state steel sheet, steel strip are molded into a pipe state, and thereafter, they are seamed by welding to be a product as a steel pipe (hereinafter, called also as a "pipe".). Further, these welded steel pipes can be classified depending on whether a hot-rolled steel sheet (hereinafter, called also as a "hot coil") is used or a plate is used as a material, and the former ones are the electric resistance welded steel pipe and the spiral steel pipe, and the latter one is the UOE steel pipe. It is general to use the latter UOE steel pipe for a high-strength, large-diameter, and thickening usages. However, the former electric resistance welded steel pipe and the spiral steel pipe using the hot coil as the material are advantageous in points of cost and delivery date thereof, and therefore, the requirements to make them high-strength, large-diameter, and to increase the thickness increase.

A large difference between the electric resistance welded steel pipe and the spiral steel pipe of which material is the hot coil exists in a tubulization method thereof. In the former electric resistance welded steel pipe, a longitudinal direction of a pipe and a rolling direction match, and a circumferential direction of the pipe matches with a width direction of the rolling as same as the UOE steel pipe. On the other hand, the latter spiral steel pipe is made such that a weld line becomes a spiral state, and the rolling direction and the pipe longitudinal direction, and the width direction of the rolling and the pipe circumferential direction do not necessarily match. It is important that almost all of properties which are incorporated into the specifications as a pipe relate to the pipe circumferential direction, and it is an R direction of the hot coil in case of the spiral steel pipe. The R direction means a direction corresponding to the circumferential direction of the steel pipe when it is made into the spiral steel pipe. It is determined by a pipe diameter at the tubulization time, but it is usually in directions of 30° to 45° relative to the rolling direction. The hot coil is generally good in both strength and toughness in the width direction of the rolling, and therefore, it is desirable because the circumferential direction of the electric resistance welded steel pipe is the width direction of the rolling. However, the circumferential direction of the spiral steel pipe is the R direction of the hot coil, and it leans to a certain angle relative to the rolling direction, and therefore, both the strength and the toughness are lowered. Accordingly, it is necessary to increase the strength for approximately 70 MPa to 90 MPA when it is converted in the width direction of the rolling even if it is the same API-X80 standard (YS: 550 MPa, TS: 620 MPa to 827 MPa) steel pipe, and therefore, the hot coil for the spiral steel pipe is necessary to have a more severe strength-toughness balance.

A manufacturing method of a high-strength steel pipe corresponding to X120 standard in the UOE steel pipe is disclosed in Non-Patent Document 1.

However, the above-stated technology assumes that a thick sheet (plate) is used as a material, and it is attained by using an Interrupted Direct Quench (IDQ) method being a characteristic of a thick plate manufacturing process, and with a high cooling rate and a low cooling stop temperature to enable both the high-strength and the thickening. In particular, it is a characteristic in which quenching strengthening (structure strengthening) is utilized to guarantee the strength.

An example of respective processes to manufacture a plate is represented in FIG. 1. Here, in a heating process, a slab reheating is performed. The heating is performed in low temperature for grain refining of heated austenite grains because it is not necessary to consider precipitation strengthening.

Strengthening of the controlled rolling to improve the toughness, namely, the increase of the rolling reduction ratio at the non-recrystallization region temperature in the austenite is able to be scheduled as required because a rolling mill thereof is not a tandem type but a single-stand reverse rolling mill. Accordingly, the aimed toughness can be obtained as long as a controlled rolling start temperature is managed.

Besides, it is general in which a finishing mill and a cooling device are kept off in distance in a thick sheet manufacturing process, and a time interval of approximately 40 seconds exists from a rolling finish time to a cooling start time. Therefore, orientation of texture is weakened and occurrence of separation is also suppressed owing to the recrystallization and diffusive ferrite transformation in the austenite. Further, recently, Accelerated Cooling (ACC) by a high-power cooling device becomes common in the thick sheet process, and the occurrence of the separation tends to be suppressed from a point of view of the cooing rate.

An example of respective processes manufacturing a hot coil being a material of the electric resistance welded steel pipe and the spiral steel pipe which are objects of the present invention is illustrated in FIG. 2. Here, an element configuration of steel is adjusted for an objected steel component in a refining process. A central segregation is reduced by electromagnetic stirring and soft reduction casting in a continuous casting process. In a slab reheating process, Nb suppressing the recrystallization of the austenite and obtaining precipitation strengthening by precipitates is made into solution. In a rough rolling process, the rolling is performed at a recrystallization temperature region of the austenite and the recrystallized austenite grain is refined. In a finish rolling process, the rolling is performed at an austenite non-recrystallization temperature region, and an a grain after transformation is refined by a controlled rolling effect. In a winding process, precipitation strengthening of NbC is obtained by winding at an appropriate temperature.

In the manufacturing of the hot coil, there is the winding process as characteristics of the process, and it is difficult to wind up a thick material at a low temperature from restriction in facility ability of a winding device (coiler). Therefore, it is impossible to perform the low temperature cooling stop necessary for quenching strengthening. Accordingly, it is difficult to secure the strength by the quenching strengthening. Besides, the facility costs too much to accelerate the cooling rate at a sheet thickness center portion as fast as the thick sheet manufacturing process as for the sheet thickness of 16 mm or more, in the cooling rate after the rolling.

Further, there is a case when a roughing mill includes the single-stand reverse rolling mill, but it is general that the finishing mill is the tandem rolling mill with six to seven stands. In addition, there are a lot of restrictions because the temperature, the rolling reduction ratio, and the speed are inevitably determined by a mass flow thereof. Besides, a rough bar thickness shifting from the rough rolling to the finish rolling is also restricted by a crop shear and a roll gap of an F1 stand, and it is impossible to set the rolling reduction ratio at the recrystallization region temperature large as the thick sheet (plate) process.

In Patent Document 1, an invention is disclosed in which Ca—Si is added at the refining time to make an inclusion spherical state, V having a crystal grain miniaturization effect is added in addition to strengthening elements of Nb, Ti, Mo, Ni, and the low-temperature rolling and the low-temperature winding are combined to secure the strength, as a technology enabling both the high-strength, the thickening, and the low-temperature toughness in the hot coil for the linepipe.

However, the finish rolling temperature is relatively low such as 790° C. to 830° C. in this technology, and therefore, there are fears in lowering of absorption energy caused by the occurrence of the separation, and in operating stability because a rolling load becomes high caused by the low-temperature rolling.

In Patent Document 2, there is a disclosure enabling both the high-strength and the low-temperature toughness by suppressing increase of hardness at a welded portion by limiting a PCM value, and making a microstructure into a bainitic ferrite single phase, and further limiting a precipitation ratio of Nb to enable the high-strength and the low-temperature toughness as the technology enabling the strength, the low-temperature toughness, and excellent field weldability in the hot coil for the electric resistance welded steel pipe. However, the low-temperature rolling is practically necessary also in this technology to obtain a fine structure, and there are fears in the lowering of the absorption energy caused by the occurrence of the separation, and in operating stability because a rolling load becomes high caused by the low-temperature rolling.

In Patent Document 3, a technology is disclosed in which the texture is controlled by limiting a lower limit of the cooling rate after the rolling in the hot coil for the electric resistance welded steel pipe and the spiral steel pipe to reduce the separation. However, it is necessary not only to suppress the separation but also to control the rolling process to thereby improve the microstructure in itself to enable both the strength of X80 and the toughness in the sheet thickness of 16 mm or more. Besides, there are currently a lot of technical obstacles from points of view of a steel sheet shape, sheet passing ability and easiness to bite a coiler mandrel to guarantee the cooling rate at the sheet thickness center portion when the sheet thickness of 16 mm or more.

In Patent Document 4, a technology is disclosed in which the microstructure is made into the bainitic-ferrite single phase, the stable strength is obtained by fine precipitates such as Nb, V, and the toughness is guaranteed by defining an average grain size of the structure within a grain size range in the hot coil for the electric resistance welded steel pipe.

However, it is objected for a thin sheet of which sheet thickness is for a half inch (12.7 mm) at most because it is for the electric resistance welded steel pipe, and there is no description about a manufacturing method of the microstructure to obtain the toughness when the sheet thickness is 16 mm or more and to obtain the grain size range. Besides, a usage in which further severe strength-toughness balance is required such as the hot coil for the spiral steel pipe than for the electric resistance welded steel pipe is not considered.

Accordingly, an object of the present invention is to provide a hot-rolled steel sheet for a spiral pipe from points of view of transportation efficiency, field welding workability, and so on having both high toughness capable of being used at an area where severe fracture-resistant property is required (in particular, at a cold district), and strength of API5L-X80 standard or more. To attain the above, an object of the present invention is to provide a high-strength hot-rolled steel sheet (hot coil) for a spiral linepipe and a method capable of manufacturing the hot-rolled steel sheet cheaply and stably in which a ductile fracture rate (SA) of DWTT at a test temperature of −20° C. is 85% or more, a separation index where lowering of absorption energy does not practically occur caused by occurrence of separation is set at 0.06 mm/mm$^2$ or less, an absorption energy at the occurrence of the separation is 240 J or more, further the API5L-X80 standard (tensile strength is approximately 710 MPa to 740 MPa or more) when the sheet thickness is 16 mm or more from a point of view of high-strength, are cleared.

Solution to Problem

The present inventors studied hard to solve the above-stated problems, and as a result, come to know that the SA is strongly correlated with a crystalline system of a microstructure at a center portion in a steel sheet thickness direction, the absorption energy is correlated with a pro-eutectoid ferrite fraction of the microstructure, the SI is correlated with a reflected X-ray intensity of the portion to devise the present invention. Summary of the present invention is as follows.

(1) A hot-rolled steel sheet satisfies:

C=0.02% to 0.08%;

Si=0.05% to 0.5%;

Mn=1% to 2%;

Nb=0.03% to 0.12%;

Ti=0.005% to 0.05%;

by mass %; and the remaining portion is made up of Fe and inevitable impurity elements, wherein a polygonal ferrite fraction is 3% or more and 20% or less, and the others are a low-temperature transformation phase and pearlite of 1% or less in a microstructure at a depth of a half thickness from a steel sheet surface, a number average grain size of the microstructure is 1 μm or more and 2.5 μm or less, an area average grain size is 3 μm or more and 9 μm or less, a standard deviation of the area average grain size of the microstructure is 0.8 μm or more and 2.3 μm or less, and a reflected X-ray intensity ratio {211}/{111} in a {211} direction and in a {111} direction relative to a plane in parallel to the steel sheet surface at the depth of the half thickness from the steel sheet surface is 1.1 or more.

Here, the "inevitable impurity element" means impurities which are not added intentionally but inevitably mixed in a raw material or during a manufacturing process and unable to exclude even if they are tried to be excluded.

(2) The hot-rolled steel sheet according to (1), further contains:

P≤0.03%;

S≤0.005%;

O≤0.003%;

Al=0.005% to 0.1%;

N=0.0015% to 0.006%;

Ca=0.0005% to 0.003%;

V≤0.15% ("0" (zero) % is not included);

Mo≤0.3% ("0" (zero) % is not included) by mass %, and wherein the hot-rolled steel sheet satisfies:

O<S/Ca<0.8

N−14/48×Ti≥"0" (zero) %.

(3) The hot-rolled steel sheet according to (2), further contains one kind or two or more kinds from among:

Cr=0.05% to 0.3%;

Cu=0.05% to 0.3%;

Ni=0.05% to 0.3%; B=0.0002% to 0.003% by mass %.

(4) The hot-rolled steel sheet according to any one of (1) to (3), further contains:

REM=0.0005% to 0.02% by mass %.

(5) The hot-rolled steel sheet according to any one of (1) to (4), wherein a maximum hardness at a central segregation portion of the steel sheet is 300 Hv or less, and a segregation band width of an average hardness of a base material+50 Hv or more is 200 μm or less.

(6) A manufacturing method of a hot-rolled steel sheet, includes:

heating a cast slab produced and cast to obtain the hot-rolled steel sheet satisfying:

C=0.02% to 0.08%;

Si=0.05% to 0.5%;

Mn=1% to 2%;

Nb=0.03% to 0.12%;

Ti=0.005% to 0.05% by mass %; and the remaining portion is made up of Fe and inevitable impurity elements, to an SRT temperature or more found by an expression (1) and 1260° C. or less;

retaining the cast slab at the temperature region for 20 minutes or more after the heating; and performing a hot-rolling to manufacture the hot-rolled steel sheet, wherein when an effective accumulated strain ($\epsilon_{eff}$) found by an expression (2) is used, the hot-rolling is performed such that the effective accumulated strain of a rough rolling is 0.4 or more, the effective accumulated strain of a finish rolling is 0.9 or more, and a product of the effective accumulated strain of the rough rolling and the effective accumulated strain of the finish rolling is 0.38 or more;

cooling the steel sheet at a cooling rate of 2° C./sec or more and 50° C./sec or less at a sheet thickness center portion of the steel sheet in a temperature region up to 650° C. after the hot-rolling is ended at an Ar3 transformation point temperature or more; and winding the steel sheet in a temperature region of 520° C. or more and 620° C. or less, wherein $$SRT(^\circ\text{ C.})=6670/(2.26-\log[\%\,Nb][\%\,C])-273 \quad (1)$$

here, [% Nb] and [% C] respectively represent contents (mass %) of Nb and C in the steel sheet, wherein $$E_{eff}=\Sigma\epsilon_i(t,T) \quad (2)$$

here, $$E_i(t,T)=\epsilon_{i0}/\exp\{(t/\tau_R)^{2/3}\},$$

$$\tau_R=\tau_0\cdot\exp(Q/RT),$$

$$\tau_0=8.46\times10^{-6},$$

$$Q=183200J,$$

$$R=8.314J/K\cdot\text{mol},$$

where t represents an accumulated time until just before the finish rolling at a pass in case of the rough rolling, and represents an accumulated time until just before the cooling in case of the finish rolling, and T represents a rolling temperature at the pass.

Here, the "effective accumulated strain" is an index of crystal grain refining effective for improvement of toughness. Namely, it relates to the number of generation sites of a new crystal grain and a speed of a grain growth of recrystallized grain, and the number of generation sites increases and the grain growth is suppressed as the value thereof is larger.

The "effective accumulated strain of the rough rolling" is defined to be the effective accumulated strain until just before the finish rolling, namely, just before a non-recrystallization region rolling. The "effective accumulated strain of the finish rolling" is a numeric value in which the strain of just before the cooling after the end of rolling, namely, just before the transformation of γ to α is found by using the expression (2).

The "hot-rolling" is a plastic process in which a sheet thickness is reduced by rolling by passing a material between rolls at an austenite temperature region to make it into a predetermined shape.

(7) The manufacturing method of the hot-rolled steel sheet according to (6), wherein the cooling is performed between respective rolling passes of the hot-rolling at the hot-rolling time.

(8) The manufacturing method of the hot-rolled steel sheet according to (5) or (6), wherein when the cast slab to obtain the hot-rolled steel sheet is continuously cast, the cast is performed while stirring molten steel by an induced electromagnetic stirring and a reduction amount of the continuous casting is controlled to match with a solidification shrinkage at a final solidification position of the cast slab.

The "induced electromagnetic stirring" is a technology in which an eddy current is induced in molten steel being an electric conductor by an AC traveling magnetic field created by an electromagnetic stirring device in a mold at a non-solidified portion in a cast slab, and the molten steel in itself is stirred by electromagnetic force generated between the eddy current and the traveling magnetic field to avoid a central concentrated segregation in a continuous casting process.

The "final solidification position" means a position where the continuous cast slab completes solidification at all thickness.

(9) The manufacturing method of the hot-rolled steel sheet according to (6), wherein the hot-rolled steel sheet is the one in which a polygonal ferrite fraction is 3% or more and 20% or less, and the others are a low-temperature transformation phase and pearlite of 1% or less in a microstructure at a depth of a half thickness from a steel sheet surface, a number average crystal grain size of the microstructure is 1 μm or more and 2.5 μm or less, an area average grain size is 3 μm or more and 9 μm or less, a standard deviation of the area average grain size is 0.8 μm or more and 2.3 μm or less, and a reflected X-ray intensity ratio {211}/{111} in a {211} direction and in a {111} direction relative to a plane in parallel to the steel sheet surface at the depth of the half thickness from the steel sheet surface is 1.1 or more.

(10) The manufacturing method of the hot-rolled steel sheet according to (6), wherein the hot-rolled steel sheet further contains:

P≤0.03%;
S≤0.005%;
O≤0.003%;
Al=0.005% to 0.1%;
N=0.0015% to 0.006%;
Ca=0.0005% to 0.003%;
V≤0.15% ("0" (zero) % is not included);
Mo≤0.3% ("0" (zero) % is not included) by mass %,
and satisfies:
O<S/Ca<0.8
N−14/48×Ti≥"0" (zero) %.

(11) The manufacturing method of the hot-rolled steel sheet according to (10), wherein the hot-rolled steel sheet further contains one kind or two or more kinds from among:

Cr=0.05% to 0.3%;
Cu=0.05% to 0.3%;
Ni=0.05% to 0.3%;
B=0.0002% to 0.003% by mass %.

Advantageous Effects of Invention

It becomes possible to manufacture a high-strength spiral linepipe which is API5L-X80 standard or more in a sheet thickness of 16 mm or more at a cold district where severe fracture resistance properties are required by using a hot-rolled steel sheet according to the present invention for an electric resistance welded steel pipe and for a spiral steel pipe. In addition, it becomes possible to obtain a hot coil for the spiral steel pipe cheaply and stably by a manufacturing method according to the present invention.

DESCRIPTION OF EMBODIMENTS

Figure 1:
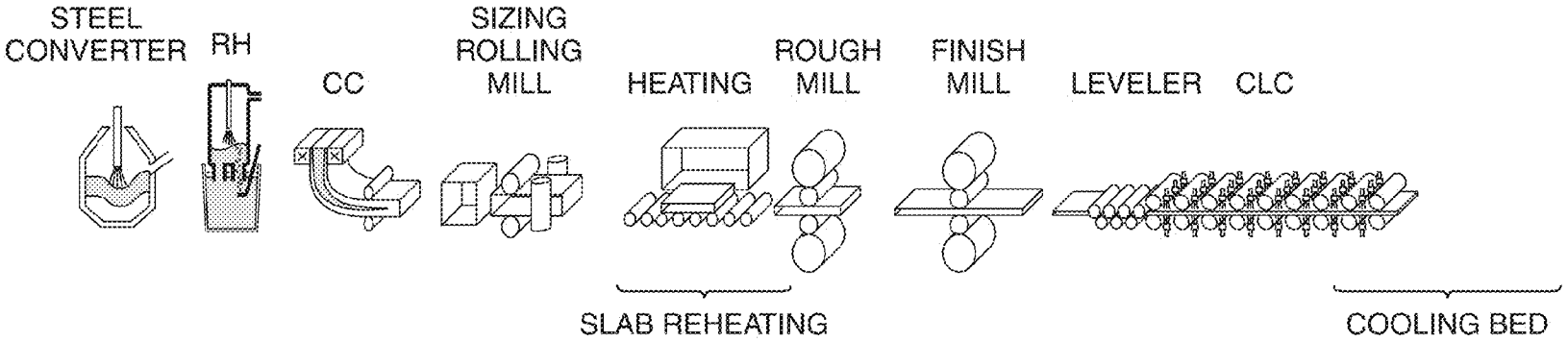
FIG. 1 is a process chart illustrating an example of respective processes manufacturing a plate.

At first, the present inventors observe a fracture surface of a hot-rolled steel sheet manufactured by a hot coil manufacturing process in detail as for a ductile fracture rate SA (−20° C.) at −20° C. of DWTT and separations of the hot-rolled steel sheet, considering to enable the hot-rolled steel sheet excellent in strength and toughness on an assumption of usage for a spiral linepipe.

As a result, patterns of occurrences of separations are examined in detail as for the fracture surface in which the separations remarkably occur though SA of 100% is obtained in appearance. As a result, they come to know that the patterns can be classified into two kinds of (1) occurrence positions of the separations are not at a sheet thickness center portion and short and a lot of separations occur, and (2) the separations occur at the sheet thickness center portion. Note that when the separations are quantified as a separation index (hereinafter: S. I.), a contribution of the pattern (2) is small, and it is verified that the separations are in a level of no problem from a practical standpoint as long as the pattern (1) is able to be suppressed in most cases.

When the pattern (1) is examined in detail, it turns out from an SEM observation and so on of a cross section that the separations are mainly separated at places considered to be a crystal grain boundary. Namely, it turns out that a crystal orientation of each crystal grain relates to a cause generating the separations of the pattern (1).

Besides, when the pattern (2) is examined in detail, it is estimated that the separation is the same as a crack so-called as a pseudo cleavage as a result of observation of the separation which is perpendicular to both a crack surface generated from a vicinity of a center of the sheet thickness and a test piece sheet thickness direction by using SEM. Namely, it turns out that an inclusion such as coarse MnS and so on to be a starting point of fracture when an addition amount of S is limited or when Ca is not added is not necessarily observed at a place considered to be the starting point. Further, it also turns out that the cleavage and a portion where elements such as Mn are thickened caused by a central segregation match. Namely, a possibility is strongly suggested in which the central segregation accounts for the cause generating the separation of the pattern (2) to some extent.

In general, the occurrence of the separation is considered to be preferable for low-temperature toughness because it lower a transition temperature. However, when an unstable ductile fracture resistant property matters such as a gas linepipe, upper shelf energy is necessary to be improved to improve the unstable ductile fracture resistant property, and it is necessary to lower the transition temperature while suppressing the occurrence of the separation to enable the above.

Accordingly, investigation assuming a case of API5L-X80 standard as an example is performed to investigate relationship among the ductile fracture rate SA (−20° C.) at −20° C. of DWTT, the separation, and a microstructure of the steel sheet, a grain size, a texture, and a central segregation. As a result, the following things are turned out.

When molten steels having components represented in Table 1 are continuously cast, REM (rare earth elements) is added to change a degree of the central segregation of a slab, and a slab casting is performed at two levels of execution or not-execution of "induced electromagnetic stirring+soft reduction" in which the cast is performed while stirring the molten steel by induced electromagnetic stirring, and the reduction is softened while controlling a rolling reduction amount to correspond to solidification shrinkage at a final solidification position of a cast slab.

TABLE 1

| | C | Si | Mn | P | S | O | Al | N | Nb | Ti | V | Mo |
|---|---|---|---|---|---|---|---|---|---|---|---|---|
| A | 0.042 | 0.28 | 1.67 | 0.005 | 0.002 | 0.002 | 0.024 | 0.003 | 0.071 | 0.01 | 0.052 | 0.24 |
| B | 0.041 | 0.28 | 1.68 | 0.005 | 0.002 | 0.003 | 0.021 | 0.004 | 0.072 | 0.011 | 0.053 | 0.24 |

| | Cr | Cu | Ni | Ca | S/Ca | N − 14/48 * Ti | REM |
|---|---|---|---|---|---|---|---|
| A | 0.16 | 0.24 | 0.24 | 0.0021 | 0.952381 | 0.0002833 | ADDED |
| B | 0.17 | 0.26 | 0.23 | 0.0024 | 0.8333333 | 0.0003917 | NOT ADDED |

Further, rolling conditions and cooling conditions when the obtained cast slab is hot-rolled are variously changed to make a crystal grain size and a microstructure as a produce steel sheet change. In particular, effects of a pass schedule at a recrystallization temperature region and a pass schedule at a non-recrystallization temperature region are studied in detail. Note that a sheet thickness of a product steel sheet is 18.4 mm.

A sample is collected from a tail 10 m position of the obtained product coil, and various test pieces are cut out from the sample. A tensile test is performed by cutting out a No. 5 test piece described at JIS Z 2201 from an R direction in accordance with a method of JIS Z 2241. The DWTT (Drop Weight Tear Test) test is performed by manufacturing a test piece in which a strip test piece with a size of 300 mmL×75 mmW×sheet thickness (t) mm is cut out from the R direction, and a 5 mm press-notch is performed thereto.

After the DWTT test is performed, the ductile fracture rate (SA (−20° C.)) thereof is measured, and the separation index (hereinafter: S. I.) is measured to digitize a degree of the separation generated at a fracture surface. The S. I. is defined to be a value in which a separation entire length ($\Sigma_i li$: $l_i$ is each separation length) which is in parallel to a sheet surface is divided by a cross-sectional area (sheet thickness×(75−notch depth)).

Figure 3:
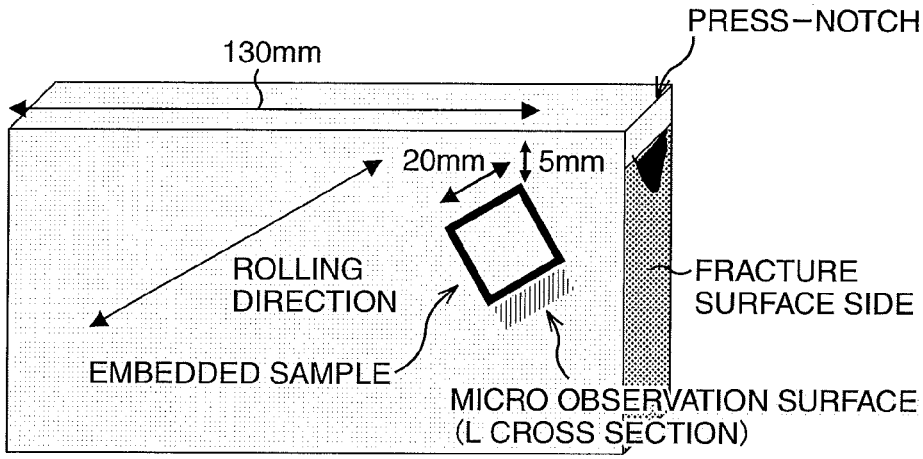
FIG. 3 is a conceptual diagram illustrating a position where a micro sample is collected from a DWTT test piece.

Further, a micro sample as illustrated in FIG. 3 is cut out to investigate the crystal grain size, the texture, the microstructure and the central segregation of each of the DWTT test pieces.

At first, EBSP-OIM™ (Electron Back Scatter Diffraction Pattern-Orientation Image Microscopy) is used to measure the crystal grain size and the microstructure from the cut out micro sample. The sample is polished by using colloidal silica abrasive for 30 minutes to 60 minutes, and an EBSP measurement is performed under measurement conditions of a magnification of 400 times, 160 μm×256 μm area, a measurement step of 0.5 μm.

The EBSP-OIM™ method is constituted by a device and software irradiating electron beams for a highly inclined sample in a scanning electron microscope (SEM), a Kikuchi pattern formed by backscattering is photographed by a high-sensitive camera and it is computer image processed to thereby measure a crystal orientation at the irradiation point within a short period of time. In the EBSP method, it is possible to perform a quantitative analysis of a fine structure and a crystal orientation of a bulk sample surface, and an analysis area thereof is an area capable of being observed by the SEM, and it is possible to analyze with a resolution of 20 nm at a minimum though it depends on the resolution of the SEM. The analysis is performed for several hours by mapping an area to be analyzed for tens of thousands points in a same interval grid state. It is possible to see a crystal orientation distribution and a size of a crystal grain within the sample in a polycrystalline material. In the present invention, an orientation difference of the crystal grain is defined to be 15° being a threshold value of a high-angle tilt grain boundary which is generally recognized as a crystal grain boundary, a grain is visualized from the mapped image, to find an average crystal grain size. Though it is described in detail later, an average grain size (total sum of grain sizes/the number of crystal grains) when a number distribution is found by each grain size of the crystal grain is set to be a "number average grain size", and an average grain size (a grain size corresponding to an average area) when a distribution is found in which the number distribution by each crystal grain size is multiplied by an average area of the grain size is set to be an "area average grain size". The "number average grain size", the "area average grain size", and a "standard deviation" of the area average grain size are values obtained by the EBSP-OIM™.

Besides, an pro-eutectoid ferrite volume fraction is found as for the microstructure by a Kernel Average Misorientation (KAM) method being equipped with the EBSP-OIM™. In the KAM method, a calculation is performed by each pixel in which the orientation difference among pixels of adjacent six pixels (first approximation) of a certain regular hexagon of a measurement data, or 12 pixels (second approximation) at outside of the six pixels, further 18 pixels (third approximation) at further outside of the 12 pixels are averaged, and the value is set to be a value of a center pixel.

It is possible to create a map representing an orientation change within a grain by performing this calculation so as not to exceed a grain boundary. Namely, this map represents a distribution of a strain based on the local orientation change within the grain. Note that as the analysis condition in the present invention, a condition calculating the orientation difference between adjacent pixels in the EBSP-OIM™ is set to be the third approximation and the one of which orientation difference becomes 5° or less is displayed. Here, the pro-eutectoid ferrite means a polygonal ferrite. In the present invention, the pro-eutectoid ferrite is defined as a planar fraction of a pixel of which orientation difference third approximation is calculated to be 1° or less.

A polygonal pro-eutectoid ferrite which transforms at a high temperature is generated as a diffusion transformation, and therefore, a dislocation density is small and a strain within the grain is small, and therefore, a difference within the grain of the crystal orientation is small. Accordingly, a polygonal ferrite volume fraction obtained by optical microscopic observation and the area fraction of an area obtained by the orientation difference third approximation 1° measured by the KAM method approximately match finely compared to various investigation results performed by inventors up to that time.

Further, a reflected X-ray surface intensity ratio is measured to obtain information of the crystal orientation. The reflected X-ray surface intensity ratio (hereinafter: surface intensity ratio) means a ratio of the reflected X-ray surface intensities in a {211} direction and a {111} direction (hereinafter, represented by {211}, {111} when it is not particularly specified) relative to a parallel surface to a steel sheet surface at a sheet thickness center portion of the steel sheet (a portion at a half depth of the sheet thickness from the steel sheet surface), namely, it is a value defined as {211}/{111}. It is a value to be measured by using X-ray by a method described in ASTM Standards Designation 81-63. A RINT1500 X-ray measurement device manufactured by Rigaku corporation is used as a measurement device of the present experiment. The measurement is performed at a measurement speed of 40 times/minute, Mo—Kα is used as an X-ray source, under a condition of a tube voltage of 60 kV, a tube current of 200 mA, and Zr—Kβ is used as a filter. A wide-angle goniometer is used as a goniometer, a step width is 0.010°, slits are a divergence slit of 1°, a scattering slit of 1°, and a light-receiving slit of 0.15 mm.

Next, an Mn concentration distribution of the steel sheet is measured by an EPMA (Electron Probe Micro Analyzer), or a CMA (Computer Aided Micro Analyzer) capable of performing image processing of a measurement result by the EPMA as for quantification of the central segregation.

At this time, a numeric value of a maximum Mn segregation amount changes depending on a probe diameter of the EPMA (or CMA). The present inventers found that the segregation of Mn is able to be properly evaluated by setting the probe diameter at 2 μm. Note that the Mn segregation amount becomes large in appearance when an inclusion such as MnS exists, and therefore, the evaluation is performed by excluding a value of the inclusion when the inclusion hits.

In the present invention, the maximum Mn segregation amount is defined to be a maximum Mn amount (wt %) at the central segregation portion among an Mn concentration in which the central segregation portion of the steel sheet, namely, at least an area of at least 1 mm in a sheet thickness direction, 3 mm in a sheet width direction of a center portion of a cross section of the steel sheet is measured by the measurement method as stated above, and an average value in the sheet width direction at each sheet thickness direction position is set to be the Mn concentration.

It is also possible to define the central segregation portion by hardness by measuring the central segregation portion of Mn measured as stated above by using a micro Vickers hardness tester. For example, an area of 1 mm in the sheet thickness direction, 3 mm in the sheet width direction is measured at 25 g×15 seconds in 50 μm pitch centering on the central segregation portion by using the micro Vickers hardness tester, and the maximum hardness among the average values of the micro Vickers hardness in the sheet width direction at each sheet thickness direction positions is defined as a maximum hardness of the central segregation portion. An average hardness in which the maximum hardness at the central segregation portion is excluded from the average hardness of each sheet thickness direction position is further averaged is defined as an average hardness of a base material. It is possible to define the area of which hardness becomes the average hardness of the base material+50 Hv or more as the central segregation portion.

Figure 4:
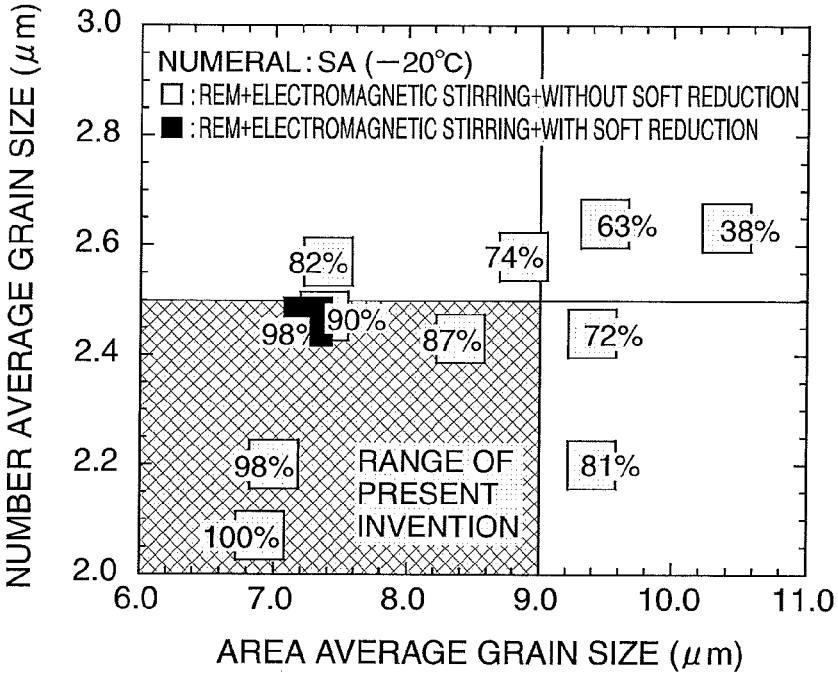
FIG. 4 is a view representing an SA (−20° C.) of a microstructure by a relationship between an area average grain size and a number average grain size of the microstructure.

The SA (−20° C.) under a condition in which a tensile strength is within a range of 710 MPa to 740 MPa is represented in FIG. 4 by a relationship between the "number average grain size" and the "area average grain size". It turns out that SA (−20° C.) 85% when the "number average grain size" is 2.5 μm or less and the "area average grain size" is 9 μm or less.

Besides, it also turns out that the SA (−20° C.) further improves even in a similar microstructure by performing the "REM addition+induced electromagnetic stirring+soft reduction".

In this test, a brittle fracture surface caused by brittle cracks estimated to be generated from just under a press-notch of the DWTT test piece once changes into a ductile fracture surface, but a pseudo cleavage perpendicular to both a crack surface generated from a vicinity of a center of the sheet thickness and a test piece sheet thickness direction becomes a starting point of the brittle fracture surface again when the fracture surface is observed in detail. Namely, it turns out that the central segregation effects on the SA (−20° C.). Namely, it turns out that there are effects of reducing the SI and increasing absorption energy by reducing the central segregation.

Figure 5:
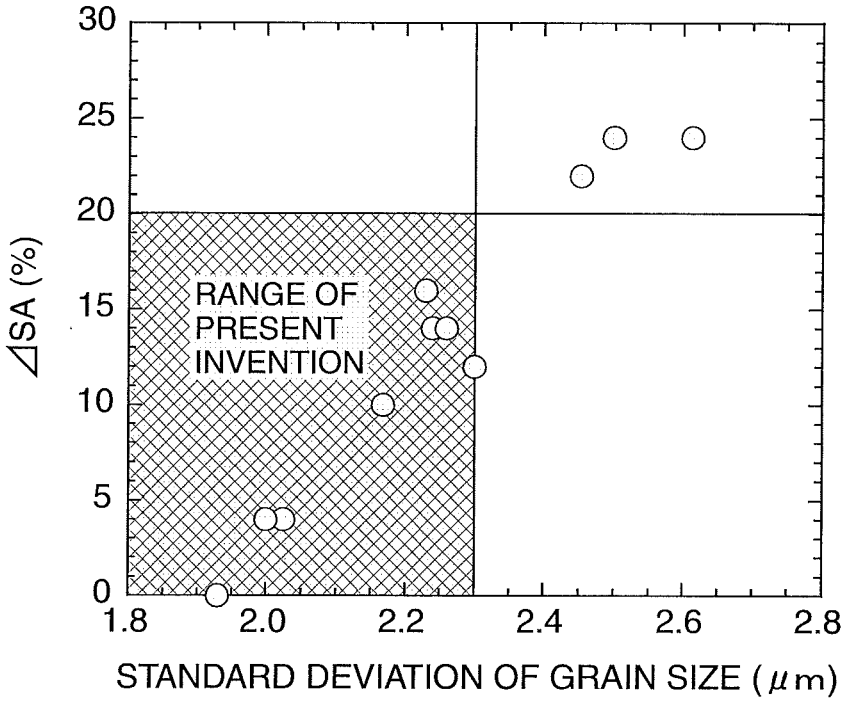
FIG. 5 is a view illustrating a relationship between a standard deviation of the number average grain size of the micro structure and dispersion (ΔSA) of the SA (−20°).

Note that all of the values of the SA (−20° C.) are average values of two samples, and some of the test pieces do not satisfy SA (−20° C.)≥85%. Accordingly, a relationship between a difference (ΔSA) of the two samples' SA (−20° C.) and the standard deviation of the area average grain size obtained by the above-stated EBSP-OIM™. The results are represented in FIG. 5. It turns out that when the "standard deviation" of the area average grain size is 2.3 μm or less, the ΔSA (−20° C.) becomes 20% or less, and dispersion of toughness is suppressed within this range. When the ΔSA (−20° C.) is 20% or less, a minimum value of the SA (−20° C.) is suppressed at approximately 75% and it is within a practically allowable range to secure SA (−20° C.)≥85% as the average value.

Figure 6:
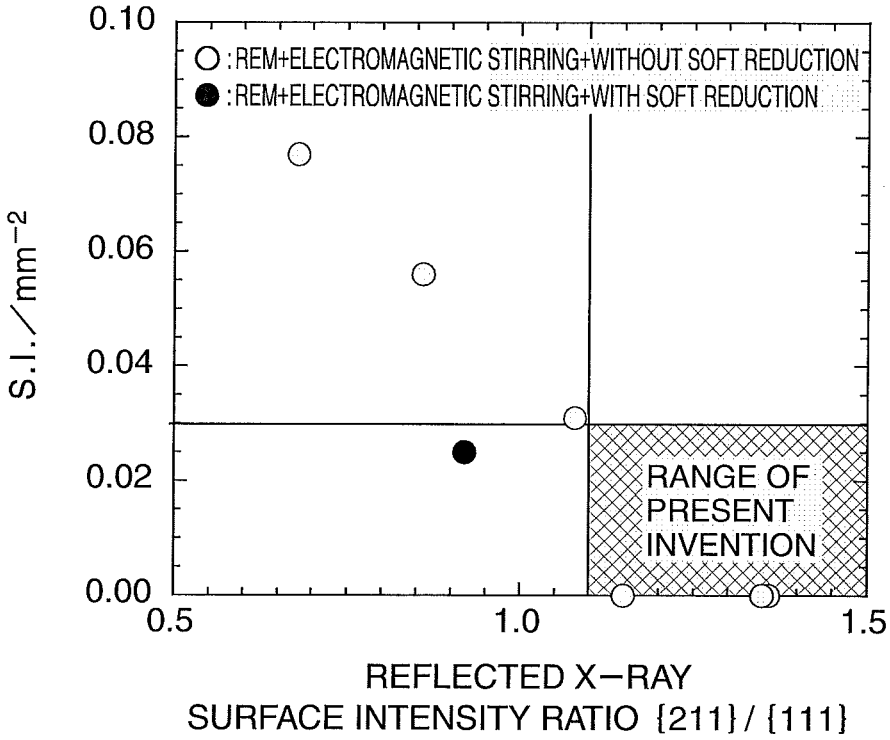
FIG. 6 is a view representing a relationship between a reflected X-ray intensity ratio at a center portion in a steel sheet thickness direction and an S.I.

A relationship between the surface intensity ratio and the S. I. is represented in FIG. 6. It turns out that the S. I. stabilizes at a low level to be a value of 0.03 or less when the surface intensity ratio is 1.1 or more. Namely, it turns out that it is possible to suppress the separation to a level of practically no problem if the surface intensity ratio is controlled to be 1.1 or more. More desirably, it is possible to make the S. I. at 0.02 or less by controlling the surface intensity ratio at 1.2 or more.

Besides, an obvious tendency is recognized in which the upper shelf energy in the DWTT test improves by the suppression of the separation. Namely, when the surface intensity ratio {211}/{111} becomes 1.1 or more, the occurrence of the separation is suppressed, the S. I. stabilizes at the low level of 0.03 or less, and the lowing of the upper shelf energy being an index of the unstable ductile fracture resistance resulting from the occurrence of the separation is suppressed, and energy of 10000 J or more can be obtained.

Note that it is preferable to set the surface intensity ratio at 0.9 or less from a point of view of suppression of planar plastic anisotropy.

The separation is resulting from plastic anisotropy of crystallographic colonies of {111} and distributed in a band state, and it is considered to occur at a boundary surface of these adjacent colonies. It is proved that {111} among these crystallographic colonies further develops in particular by a α (ferrite)+γ (austenite) two-phase region rolling at less than an Ar3 transformation point temperature. On the other hand, when the rolling is performed at a non-recrystallization temperature of the γ region of the Ar3 transformation point temperature or more, a Cu type texture being a representative rolling texture of an FCC metal is strongly formed, and it is known that the texture in which {111} develops is formed after the γ to α transformation. It is therefore possible to avoid the occurrence of the separation by suppressing the development of these textures.

Figure 7:
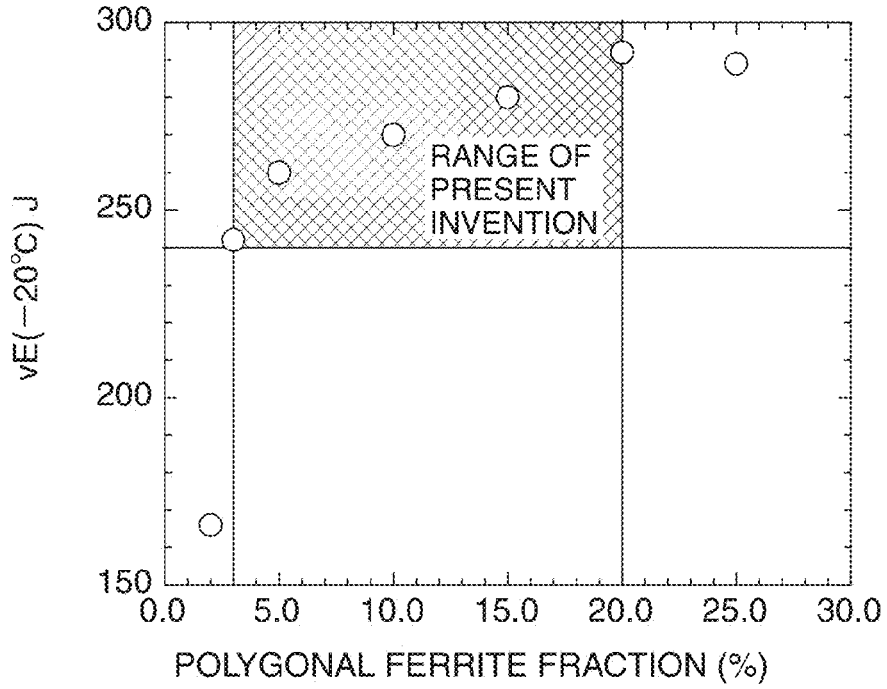
FIG. 7 is a view representing a relationship between a pro-eutectoid ferrite fraction (%) and Charpy absorbed energy of the microstructure.

Next, a V-notch Charpy test is performed to investigate a relationship between the absorption energy and the microstructure, a micro sample is cut out from a vicinity of the fracture surface, and a relationship between the absorption energy (vE (−20° C.)) and the pro-eutectoid ferrite fraction is investigated. Note that a Charpy impact test is performed by cutting out a test piece described in JIS Z 2202 from an R direction at a sheet thickness center in accordance with a method of JIS Z 2242. The pro-eutectoid ferrite fraction is a value obtained by the above-stated EBSP-OIOM™ method. A relationship between the pro-eutectoid ferrite fraction under a condition in which a tensile strength is within a range of 710 MPa to 740 MPa and the vE (−20° C.) is represented in FIG. 7.

There is a good correlation between the pro-eutectoid ferrite fraction and the vE (−20° C.), and it turns out that a target value that the vE (−20° C.) is 240 J can be obtained when the pro-eutectoid ferrite fraction is 3% or more.

Figure 8:
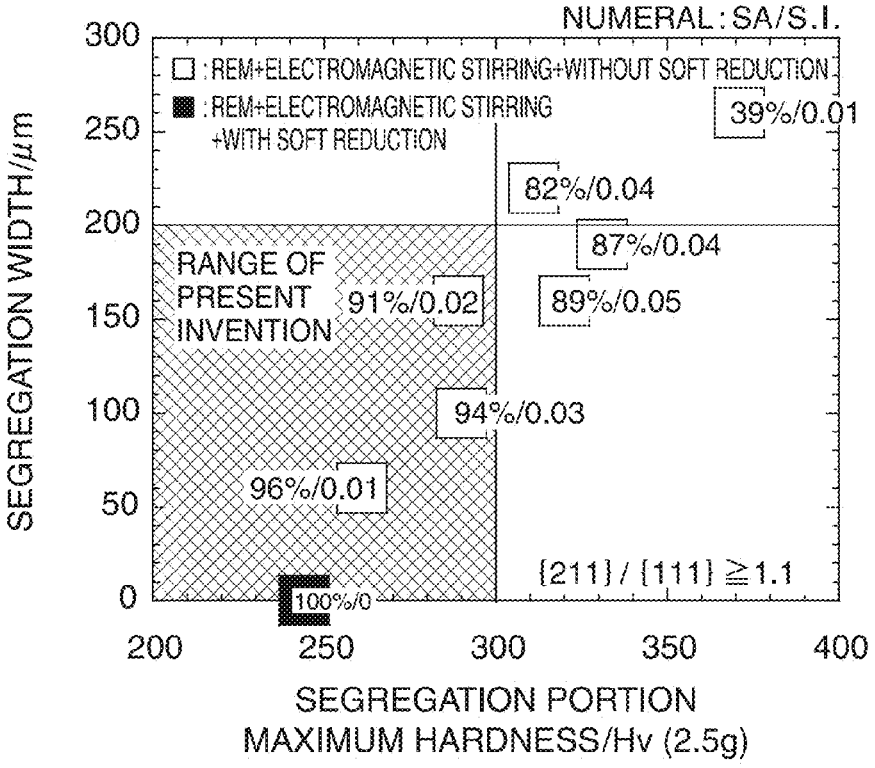
FIG. 8 is a view representing the SA and the S.I. of the microstructure by a relationship between a segregation portion highest-hardness (Hv) and a segregation width.

A result in which an effect of the central segregation added on the SA (−20° C.) and the S. I. is further investigated in detail is represented in FIG. 8. The central segregation portion means a segregation layer containing elements easy to be solidified and segregated such as C, P, Mn, Nb, Ti existing at a cross-sectional center portion of the steel sheet, and the above-stated Mn central segregation is also included. It turns out that when the hardness (Vickers hardness Hv) of the central segregation portion is a maximum hardness 300 Hv, and a width (length in the steel sheet width direction) of the segregation band of the average hardness of the base material+50 Hv or more is 200 μm or less, SA (−20° C.)≥85%, S. I.≤0.03 $mm^{-2}$, and both the SA (−20° C.) and the S. I. clear the target values.

The hot-rolled steel sheet used in the present invention is a steel sheet containing the following chemical components by mass %, and the remaining portion is composed of Fe and inevitable impurity elements.

C=0.02% to 0.08%,
Si=0.05% to 0.5%,
Mn=1% to 2%,
Nb=0.03% to 0.12%,
Ti=0.005% to 0.05%,
P≤0.03%,
S≤0.005%,
O≤0.003%,
Al=0.005% to 0.1%,

N=0.0015% to 0.006%,
Ca=0.0005% to 0.003%,
V≤0.15% (excluding "0" (zero) %),
Mo≤0.3% (excluding "0" (zero) %),
are contained, and
O<S/Ca<0.8
N−14/48×Ti≥"0" (zero) %

At this time, the hot-rolled steel sheet may further contain one kind or two or more kinds of the following elements by mass %.

Cr=0.05% to 0.3%,
Cu=0.05% to 0.3%,
Ni=0.05% to 0.3%,
B=0.0002% to 0.003%

Subsequently, limitation reasons of the chemical components of the hot-rolled steel sheet in the present invention are described.

C is the element necessary for obtaining the aimed strength of API5L-X80 standard or more and the microstructure. Note that it is impossible to obtain the necessary strength if it is less than 0.02%, and when it is added more than 0.06%, many carbides to be a starting point of fracture are formed, as a result, not only the toughness, in particular, the absorption energy are lowered but also a field weldability remarkably deteriorates. Accordingly, an addition amount of C is set to be 0.02% or more and 0.06% or less. Besides, it is desirable to be 0.05% or less to obtain homogeneous strength independent of a cooling rate at a cooling after the rolling.

Si has an effect suppressing precipitation of the carbide to be the starting point of fracture, and therefore, it is added 0.05% or more, but the field weldability deteriorates when it is added more than 0.05%. When general versatility is considered from a point of view of the field weldability, it is desirable to be 0.3% or less. Further, there is fear in which a scale pattern in a tiger stripe state is generated and it may cause disfigurement of a surface when it is added more than 0.15%, and therefore, it is desirable to set an upper limit thereof at 0.15%.

Mn is a solid-solution strengthening element, and therefore it is added according to need. However, a rigid segregation band to be the starting point of the separation is formed because it segregates to a cast slab center at a casting time. Accordingly, a possibility becomes large in which the maximum Mn segregation amount exceeds 2% if it is added more than 2% even if how the casing is performed. As a result, the SI becomes worse, and requirements of the present invention are not satisfied. It is desirable to added 1.8% or less to reduce the SI while considering variation of the maximum Mn segregation amount.

P is an impurity, and it is more desirable as it is lower. It segregates to a center portion of a continuous casting steel billet when it is contained more than 0.03% to incur a grain boundary fracture and to remarkably lower the low-temperature toughness, and therefore, it is set to be 0.03% or less.

Further, P adversely affects on a tubulization and the field weldability, and therefore, it is desirable to be 0.015% or less considering the above.

S not only incurs cracks at the hot-rolling time but also deteriorates the low-temperature toughness if the addition amount is too much, and therefore, it is set to be 0.005% or less. Further, S segregates in a vicinity of the center of the continuous casting steel billet as MnS, forms extended MnS after the rolling to be the starting point of the brittle fracture, and becomes a cause of occurrence of a pseudo separation (treated as the separation in the present invention) such as a lamination fault sheet crack. Besides, it is desirable to be 0.001% or less in consideration of sour-resistant property.

O is an impurity, and an upper limit thereof is limited to be 0.003% or less to suppress aggregation of oxides, and to improve a hydrogen induced cracking resistant property. It is desirable to set the upper limit value of the O amount at 0.002% or less to suppress generation of the oxide and to improve the base material and HAZ toughness.

Al is a deoxidizing element, and it is added 0.005% or more to obtain an effect thereof. On the other hand, the effect saturates if the addition amount exceeds 0.1%. Besides, a cumulative cluster of an Al oxide is verified when it exceeds 0.03%, and therefore, it is desirable to be 0.03% or less. When further severe low-temperature toughness is required, it is preferable to set an upper limit of the Al amount at 0.017% or less.

Nb is one of the most important elements in the present invention. Nb has effects of suppressions of recovery, recrystallization and grain growth of the austenite during the rolling or after the rolling owing to a dragging effect in a solid-solution state and/or a pinning effect as a carbonitride precipitates, refining grains of the average crystal grain size after transformation, and improving the low-temperature toughness. Further, it generates fine carbides and contributes to improvement of the strength by precipitation strengthening thereof in a winding process being a characteristic of the hot coli manufacturing process. Note that it is necessary to add it at least 0.05% or more to obtain these effects as stated above. On the other hand, not only the effects saturate but also it becomes difficult to solid-solve at a heating process before the hot-rolling process, forms a coarse carbonitride to be the starting point of fracture, and there is a possibility in which the low-temperature toughness and the sour-resistant property deteriorate if it is added more than 0.12%.

Ti is one of the most important elements in the present invention. Ti starts to precipitate as a nitride at a high-temperature just after solidification of the cast slab obtained by the continuous casting or an ingot casting. The precipitates containing the Ti nitride is stable at high-temperature, and it exhibits the pinning effect without being completely solid-solved at a later slab reheating, suppresses austenite grain to be coarse during the slab reheating, miniaturizes the microstructure to improve the low-temperature toughness. The Ti addition of at least 0.005% or more is necessary to obtain the effects as stated above. On the other hand, the effects saturate if it is added more than 0.02%. Further, when the Ti addition amount exceeds a stoichiometric component with N (N−14/48×Ti≤"0" (zero) %), the remained Ti bonds to C, and there is a possibility in which HIC resistant property and the toughness are lowered.

Ca is an element generating CaS sulfide, suppressing generation of MnS extending in the rolling direction, and remarkably contributing to the improvement of the low-temperature toughness. When an Ca addition amount is less than 0.0005%, the effects cannot be obtained, and therefore, a lower limit value is set to be 0.0005% or more. On the other hand, when the Ca addition amount exceeds 0.003%, a Ca oxide accumulates and similarly has possibility to be the starting point of the brittle fracture, and therefore, an upper limit is set to be 0.003% or less.

In the present invention, Ca is added to form CaS, and thereby, S is fixed. Therefore, S/Ca ratio is an important index. It is stoichiometrically set to be S/16=Ca/20 from atomic weights of S and Ca. Namely, when the ratio of S/Ca is 0.8 or more, MnS is generated, and extended MnS is formed at the rolling time. As a result, the low-temperature toughness deteriorates. Accordingly, the S/Ca ratio is set to be less than 0.8.

N forms Ti nitride as stated above, suppresses the austenite grain to be coarse during the slab reheating, refining the austenite grain size at a later controlled rolling, and refining the average grain size after the transformation to improve the low-temperature toughness. Note that the effects cannot be obtained when the content thereof is less than 0.0015%. On the other hand, ductility is lowered caused by aging, and moldability when it is tubulized is lowered if it is contained more than 0.006%. When the N content is less than a stoichiometric component with Ti ($N-14/48\times Ti \leq$ "0" (zero) %), the remained N bonds to C, and there is a possibility in which HIC resistant property and the toughness are lowered.

Next, reasons to add V, Mo, Cr, Ni, Cu are described. A major object to further add these elements in addition to the basic components is to expand a manufacturable sheet thickness and to enable improvement of properties such as the strength and toughness of the base material without damaging excellent characteristics of the steel according to the present invention.

V generates a fine carbonitride in the winding process being the characteristic of the hot-coil manufacturing process, and contributes to improvement of the strength by the precipitation strengthening thereof. Note that the effect saturates if it is added more than 0.15%. Besides, it is desirable to be less than 0.1% because there is a probability in which the field weldability is lowered if it is added 0.1% or more. Besides, it is effective in a very small amount, but it is desirable to be added 0.02% or more.

Mo has effects improving a quenching property and increasing the strength. Besides, Mo has effects strongly suppressing the recrystallization of the austenite at the controlled rolling time, miniaturizing the austenite structure, and improving the low-temperature toughness together with Nb. Note that the effects saturate if it is added more than 0.3%. Besides, there is a probability in which ductility is lowered and moldability when it is tubulized is lowered if it is added 0.2% or more, and therefore, it is desirable to be less than 0.2%. Besides, it is effective in a very small amount, but it is desirable to be added 0.02% or more.

Cr has an effect increasing the strength. Note that the effect saturates if it is added more than 0.3%. Besides, there is a probability in which the field weldability is lowered if it is added 0.15% or more, and it is desirable to be less than 0.15%. Besides, the effect cannot be expected if it is added less than 0.05%, and therefore, it is desirable to be added 0.05% or more.

Cu has effects improving corrosion resistance and the hydrogen induced cracking resistant property. Note that the effects saturate if it is added more than 0.3%. Besides, there is a probability in which brittle cracks occur at the hot-rolling time and it causes a surface flaw if it is added 0.2% or more, and therefore, it is desirable to be less than 0.2%. Besides, the effects are not expected if it is added less than 0.05%, and therefore, it is desirable to add more than 0.05%.

Ni seldom forms a cured structure harmful for the low-temperature toughness and the sour resistant property in a rolled structure (in particular, at the central segregation band of the slab) compared to Mn, Cr, Mo, and therefore, there is an effect improving the strength without deteriorating the low-temperature toughness and the field weldability. Note that the effects saturate if it is added more than 0.3%. Besides, there is an effect preventing hot brittle of Cu, and therefore it is added ⅓ or more of the Cu amount as a target. The effects cannot be expected if it is added less than 0.05%, and therefore, a lower limit is set to be 0.05%.

B has effects improving the quenching property and making it easy to obtain a continuous cooling transformation structure. Further, B increases the quenching property improving effect of Mo and has an effect synergistically increasing the quenching property together with Nb. Accordingly it is added according to need. Note that it is insufficient to obtain the effects if it is added less than 0.0002%, and slab cracks occur if it is added more than 0.003%.

REM has effects uniformly dispersing fine oxides in a molten steel by reforming an alumina-based inclusion, further helping the oxides to be a nucleus of equiaxial crystal generation. Note that the effects cannot be obtained if it is added less than 0.0005%, and when it is added more than 0.02%, these oxides are generated in bulk, clusters, coarse inclusion are generated, the low-temperature toughness of welding seam is deteriorated, and the field weldability is adversely affected. Besides, it is an element changing a form of a non-metal inclusion becoming the starting point of fracture and deteriorating the sour-resistant property to be harmless.

Next, the microstructure and so on of the steel sheet in the present invention is described in detail.

The microstructure of the steel sheet is necessary to be as follows to attain the objected strength, the low-temperature toughness, and so on: a pro-eutectoid ferrite fraction is 3% or more and 20% or less and the other is a low-temperature transformation product in the microstructure at a depth of a half thickness of a steel sheet thickness, a number average crystal grain size of a whole of the microstructure is 2.5 μm or less, an area average grain size is 9 μm or less, and a standard deviation thereof is 2.3 μm or less.

A large temperature deviation occurs between front and rear surfaces of a sheet and a sheet thickness center when the sheet thickness is 16 mm or more, and a temperature history at each sheet thickness position from start to end of the rolling directly affects on formation of the microstructure and so on. In particular, a triaxial stress intensity is the highest at the sheet thickness center portion, and the starting point of fracture is the sheet thickness center portion. Further, there is the best correlation between the microstructure and so on and materials such as the SA, and therefore, the microstructure and so on at the half thickness is set to be a representative of the whole sheet thickness.

Here, a difference between the number average crystal grain size and the area average grain size is mentioned. Both of these numeric values can be obtained by the above-stated EBSP-OIM™ method. In both of them, the grain boundary is defined to be 15° being a threshold value of a high-angle tilt grain boundary which is generally recognized as the crystal grain boundary, and an area surrounded by the grain boundary is a crystal grain. A size distribution of measured grains is drawn by a histogram, and an average value thereof is the "number average crystal grain size" defined in the present invention. On the other hand, a histogram is drawn in which an average area is weighted (find a product) to the numeric value by each size step of the above histogram, and an average value thereof is the "area average grain size" defined in the present invention. This value makes the optical microscopic observation and so on approximate to an impression of the microstructure which can be seen with naked eyes and a comparison method and an intercept method defined in JIS.

Here, the microstructure of the hot coil for the spiral linepipe to be the object of the present invention is classified into a very fine grain structure corresponding to the "pro-eutectoid ferrite" defined in the present invention and the others, namely, a "low-temperature transformation phase" in which a grain size thereof is relatively coarse, relates to a prior austenite grain size, and estimated to transform to be massive, when it is observed in detail. In other words, the "number average crystal grain size" mainly represents the grain size of the "pro-eutectoid ferrite", and the "area average grain size" represents the grain size of the "low-temperature transformation phase". Besides, the "standard deviation" is an index representing a grain size difference between these.

According to a result of the detailed studies of the present inventors, an understanding in which the toughness improves as the crystal grain is refined in a relationship between the "crystal grain" and the "toughness" which has been considered is not a versatile rule, but it is a relationship which comes into effect only when the microstructure can be regarded as an approximately a single phase such as the ferrite or a bainite. In case of the high-strength steel at API-X80 grade being the object of the present invention, the microstructure inevitably becomes the microstructure in which the "pro-eutectoid ferrite" and the "low-temperature transformation phase" are mixed, and therefore, the general average crystal grain size just represents the "area average grain size", namely, the grain size of the "low-temperature transformation phase", and it is not appropriate.

Further, in the cleavage fracture, a weakest link model is proposed. For example, in case of the cleavage fracture, not only in a vicinity of a crack tip but also a whole of a plastic region are able to be a crack occurrence starting point. When this is defined as a process zone, fracture of the whole may be incurred if the weakest unit among the process zone fractures. In this case, a threshold value (in this case, the "number average crystal grain size" and the "area average grain size") defining a lower limit of the weakness becomes necessary in each of the "pro-eutectoid ferrite" and the "low-temperature transformation phase" though a question asking which one of the two is the weakest unit is put aside. Besides, the dispersion of these is also important, and the "standard deviations" thereof have to be defined to obtain the stable toughness.

In the present invention, it is preferable that the number average crystal grain size is 1 μm or more, the area average grain size is 3 μm or more, and the standard deviation is 0.8 μm or more in consideration of difficulty in operation. These threshold values in the present invention are as follows: the number average crystal grain size is 1 μm or more and 2.5 μm or less, the area average grain size is 3 μm or more and 9 μm or less, and the standard deviation is 0.8 μm or more and 2.3 μm or less.

The pro-eutectoid ferrite is the microstructure relatively full of ductility, and the absorption energy increases as a volume fraction increases owing to the effect of the ductility. The pro-eutectoid ferrite of 3% or more is necessary to obtain the aimed absorption energy, but not only the effect saturates but also the lowering of the strength becomes remarkable when it exceeds 20%.

Accordingly, it is necessary that the pro-eutectoid ferrite is 3% or more and 20% or less. Note that existence of the pro-eutectoid ferrite is effective to reduce a yield ratio of the steel pipe after the tubulization. In particular, recently, design is mainly carried out by a Strain Based Design, and it is desired to lower yield strength after the tubulization. It is desired that the pro-eutectoid ferrite is contained at least 3% or more in the volume fraction to make the yield ratio after the tubulization at desired 0.93 or less. Further, there are remarkable effects in the increase of the absorption energy and the suppression of the separation by controlling the content of the pro-eutectoid ferrite at 20% or less. It is estimated because a pseudo cleavage fracture propagating at a boundary between the pro-eutectoid ferrite and the low-temperature transformation phase is suppressed.

The separation which is estimated not to be affected by the central segregation at the sheet thickness center among the separations arises from a plastic anisotropy of the crystallography colonies of {111} and {100} distributed in a band state, and it is considered that the separation occurs at a boundary surface of these adjacent colonies. Accordingly, the reflected X-ray intensity ratio {211}/{111} between the {211} plane and the {111} plane which are in parallel to the sheet surface of the sheet thickness center portion is used as an index, and it is possible to suppress the separation up to a level in which the plastic anisotropy of the crystallography colonies is able to suppress the separation when a value of the reflected X-ray intensity ratio is 1.1 or more.

The central segregation generated at the slab casting time adversely affects on propagation of brittle cracks at the DWTT test, and further promotes the occurrence of the separation. The DWTT test is a test method evaluating how the propagation of the brittle cracks generated from the press-notch portion is delayed by a plastic deformation forming a ductile fracture surface at the test time, but a rigid band state structure generated as a result of the central segregation is difficult to be plastically deformed, and therefore, the propagation of the brittle cracks is accelerated. Besides, the central segregation generates the pseudo cleavage to be the starting point of the separation. Accordingly, the central segregation, in particular, the central segregation of Mn has to be reduced as much as possible to improve the SA of the DWTT being the index of the low-temperature toughness while suppressing the occurrence of the separation. However, it is possible to suppress the occurrence of the separation while securing the SA when a maximum hardness of the central segregation portion is 300 Hv or less, a segregation band width of the base material average hardness+50 Hv or more is 200 μm or less. Besides, a width of the rigid band state structure in the sheet thickness direction is also desirable to be narrower, and the occurrence of the separation is further suppressed when a thickness of the segregation band of which Mn concentration is 1.8% or more is 140 μm or less in the sheet thickness direction.

To obtain the strength of the steel sheet, there is a case when the strength falls short by only containing the low-temperature transformation phase of which hardness is relatively high within the above-stated microstructure. In this case, it is important that the precipitates containing Nb in nanometer size is densely dispersed to enable the precipitation strengthening of the whole of the microstructure. Compositions of the nanometer size precipitates are mainly Nb, but it is allowed to contain Ti, V, Mo, Cr forming the carbonitride. Besides, the winding temperature range is set to be 520° C. to 620° C. so that these precipitates appropriately contribute to the strengthening.

Note that when the cooling rate at a run-out-table is fast as 20° C./sec or more at the sheet thickness center and the winding temperature is 500° C. or less, the pro-eutectoid ferrite volume fraction 20%, and it is possible to secure the strength of X80 grade by the structure strengthening of the low-temperature transformation phase even if it is a subaging state in which the precipitates containing nanometer size Nb do not exhibit enough precipitation strengthening ability.

It is necessary that a microstructure containing coarse carbide such as cementite is not contained to improve the absorption energy being an index of a ductile fracture stopping performance required when a natural gas pipeline is assumed. Namely, the low-temperature transformation phase in the present invention does not contain the microstructure containing the coarse carbide such as cementite.

Here, the low-temperature transformation phase is represented by a microstructure appears when it is cooled too much than an equilibrium state at the cooling time or after the winding at the run-out-table. For example, it is the microstructure corresponding to a continuous cooling transformation structure (Zw) described in The Iron and Steel Institute of Japan, Society of basic research, Bainite Research Committee/Edition; Recent Study relating to Bainite structure and transformation action of low-carbon steel—the Final Report of Bainite Research Committee (1994, The Iron and Steel Institute of Japan).

Namely, it is defined that the microstructure of the continuous cooling transformation structure (Zw) is a microstructure mainly made up of Bainitic ferrite ($\alpha^{\circ}_{B}$), Granular bainitic ferrite ($\alpha_B$), Quasi-polygonal ferrite ($\alpha_q$), further contains a small amount of retained austenite ($\gamma_r$), Marten site-austenite (MA) as it is described in the above-stated reference document page 125 to page 12 as an optical microscopic observation structure. An internal structure of the $\alpha_q$ does not appear by etching as same as a polygonal ferrite (PF), but a shape of the $\alpha_q$ is acicular, and it is apparently distinguished from the PF. Here, a peripheral length of an objected crystal grain is set to be lq, and a circle-equivalent diameter is set to be dq, then a grain satisfying a condition in which a ratio (lq/dq) is lq/dq≥3.5 is the $\alpha_q$.

Further, it is necessary to set the number average crystal grain size is 2.5 μm or less, the area average grain size is 9 μm or less, and the standard deviation is 2.3 μm or less of the whole of the microstructure including the above to improve the low-temperature toughness. This is because the crystal grain size having a direct relationship with a fracture surface unit considered to be a main affector of the cleavage fracture propagation in the brittle fracture is refined, and the low-temperature toughness improves.

Next, limitation reasons of a manufacturing method of the present invention are described in detail.

In the present invention, the manufacturing method prior to the continuous casting process is not particularly limited. Namely, a process refining by a steel converter is performed by passing through a molten iron preliminary treatment such as a molten iron dephosphorization and a molten iron desulfurization after tapping of molten pig iron from a shaft furnace, otherwise, a process dissolving a cold iron source such as scrap by an electric furnace and so on, and subsequently, a component adjustment is performed so as to be an aimed component content by various secondary refining, next, it is cast by a method such as a normal continuous casting, a casting by an ingot method, and in addition, a thin slab casting.

Note that a countermeasure against the segregation such as unsolidified rolling reduction is performed for a continuous cast segment to reduce the central segregation at the slab casting time. Otherwise, it is necessary to suppress a width in the sheet thickness direction of the central segregation by making the slab cast thickness thin.

At first, $Al_2O_3$-based inclusion is reformed into a fine oxide containing REM by adding REM, the oxide is uniformly dispersed in a molten steel, electromagnetic stirring is performed thereto to lower a degree of superheat of the molten steel, to thereby effectively use the finely dispersed oxide as a nucleus of an equiaxial crystal generation, and the fine equiaxial crystals are generated in the cast slab to suppress the segregation of Mn.

Next, soft reduction at a final solidification time in the continuous casting is optimum. The soft reduction at the final solidification time is a flow of concentrated molten steel to non-solidification portion at a center portion generated by movement of the concentrated molten steel resulting from solidification shrinkage and so on to compensate a degree of the solidification shrinkage and it is performed for suppression. It is thereby possible to reduce the central segregation.

Concretely, REM is added within a scope of the present invention, when the molten steel is cast under a condition in which a stirring flow velocity of the molten steel by induced electromagnetic stirring at a position of 10 m under a mold from meniscus in mold is 30 cm/s to 100 cm/s, the continuous casting is performed at a reduction speed represented by a product of a casting speed (m/min) and a set reduction gradient (mm/m) is within a range of 0.7 mm/min to 1.1 mm/min at a facility of which roll pitch at a position corresponding to solidification ending is 250 mm to 360 mm in which a center solid phase ratio becomes 0.3 to 0.7.

In case of a slab obtained by the continuous casting or a thin slab casting, the slab may be directly transferred to a hot-rolling mill as it is in a high-temperature cast slab state, otherwise, it may be hot-rolled after it is cooled to a room temperature and reheated by a heating furnace. Note that when a slab direct rolling (HCR: Hot Charge Rolling) is performed, it is desirable to cool to less than Ar3 transformation point temperature to break a cast structure by transformations of γ to α to γ and to make the austenite grain size at the slab reheating time small. It is more desirable to cool to less than An transformation point temperature.

At the hot-rolling time, a slab reheating temperature (SRT) is set to be a temperature or more calculated by the following expression (1).

$$SRT(^{\circ}\,C.)=6670/(2.26-\log[\%\,Nb][\%\,C])-273 \quad (1)$$

Where [% Nb], [% C] respectively represent contents (mass %) of Nb, C in a steel material. This expression is to represent a solution temperature of NbC by a solubility product of NbC. When the slab reheating temperature is less than this temperature, a coarse carbonitride of Nb generated at the slab manufacturing time is not enough dissolved, and not only a grain refining effect of crystal grains owing to the suppression of recovery, recrystallization and grain growth of austenite owing to Nb at a later rolling process, and delay of γ/α transformation cannot be obtained, but also the effect generating a fine carbide and improving the strength owing to the precipitation strengthening at the winding process being the characteristic of the hot coil manufacturing process cannot be obtained. Note that when the heating is performed less than 1100° C., a scale-off amount is small and there is a possibility in which the inclusion at a slab surface layer cannot be removed together with the scale by a later descaling, and therefore, the slab reheating temperature is desirable to be 1100° C. or more.

On the other hand, when the slab reheating temperature is more than 1260° C., the grain size of the austenite becomes coarse, a prior austenite grain at a later controlled rolling becomes coarse, the average crystal grain size after the transformation becomes also coarse, and the improvement effect of the low-temperature toughness cannot be expected. It is more desirable to be 1230° C. or less.

As for a slab heating time, the slab is retained for 20 minutes or more after it reaches a corresponding temperature to fully proceed the dissolution of the Nb carbonitride. When the time is less than 20 minutes, the coarse carbonitride of Nb generated at the slab manufacturing time is not fully dissolved, and the grain refining effect of the crystal grains owing to the suppression of the recovery, recrystallization and grain growth of the austenite during the hot rolling time, and the delay of γ/α transformation, the effect generating the fine carbide and improving the strength owing to the precipitation strengthening at the winding process cannot be obtained.

The subsequent hot rolling process is generally constituted by a rough rolling process made up of several stages of rolling mills including a reverse rolling mill and a finish rolling process in which six stages to seven stages of rolling mills are disposed in tandem. In general, the rough rolling process has advantages in which the number of passes and a rolling reduction amount in each pass can be freely set, but each interpass time is long and there is a possibility in which the recovery and the recrystallization between the passes proceed. On the other hand, the finish rolling process is a tandem type, and therefore, the number of passes is the same number as the number of rolling mills, but each interpass time is short, and there is a characteristic in which a controlled rolling effect is easy to be obtained. Accordingly, a process design taking fully advantage of the characteristics of these rolling processes becomes necessary in addition to the steel components to enable the excellent low-temperature toughness.

Besides, when the product sheet thickness exceeds 16 mm, and a biting gap of a first finish rolling mill is limited from facility restriction and so on, it is impossible to improve the toughness being the requirement of the present invention by earning a rolling reduction ratio of a non-recrystallization temperature region only by the finish rolling process, and therefore, the rough rolling process is effectively used, and it is very important to refine the recrystallization austenite grain size at the recrystallization region rolling just before the non-recrystallization region rolling.

The present invention is objected to the one of which product thickness is 16 mm or more, and a principle of the present invention is how to refine the recrystallization austenite grain size. However, different from the finish rolling in which: a multistage tandem rolling mill is used in which a rolling strain, a rolling temperature and an interpass time which are metallurgically important items are determined if a pass schedule, a rolling start temperature and a rolling speed are determined; in addition, the continuous rolling is performed, the rough rolling is a combination of single stand rolling mills, and operating flexibility thereof is large, but in reverse, combinations of the optimum pass schedule, the rolling start temperature and the rolling speed refining the above-stated recrystallization austenite grain size exist in countless numbers, and the present inventors apply the mind to quantify the method enabling the present invention.

Accordingly, indexes are settled in which the pass schedule, the rolling start temperature and the rolling speed, more specifically, the temperature, the interpass time, the rolling strain are uniformly evaluated. Namely, the present inventors found that an effective accumulated strain ($\epsilon_{eff}$) calculated by the following expression (2) is used, and thereby, conditions at the rolling time of the thick steel sheet of which sheet thickness is 16 mm or more can be uniformly represented.

$$E_{eff}=\Sigma\epsilon_i(t,T) \quad (2)$$

here, $$E_i(t,T)=\epsilon_{io}/\exp\{(t/\tau_R)^{2/3}\},$$

$$\tau_R=\tau_0\cdot\exp(Q/RT)\tau_0=8.46\times10^{-6},$$

$$Q=183200J,$$

$$R=8.314J/K\cdot\text{mol},$$

where "t" represents an accumulated time until just before the finish rolling at the corresponding pass in case of the rough rolling, and represents an accumulated time until just before the cooling in case of the finish rolling, and "T" represents the rolling temperature at the corresponding pass.

Figure 9:
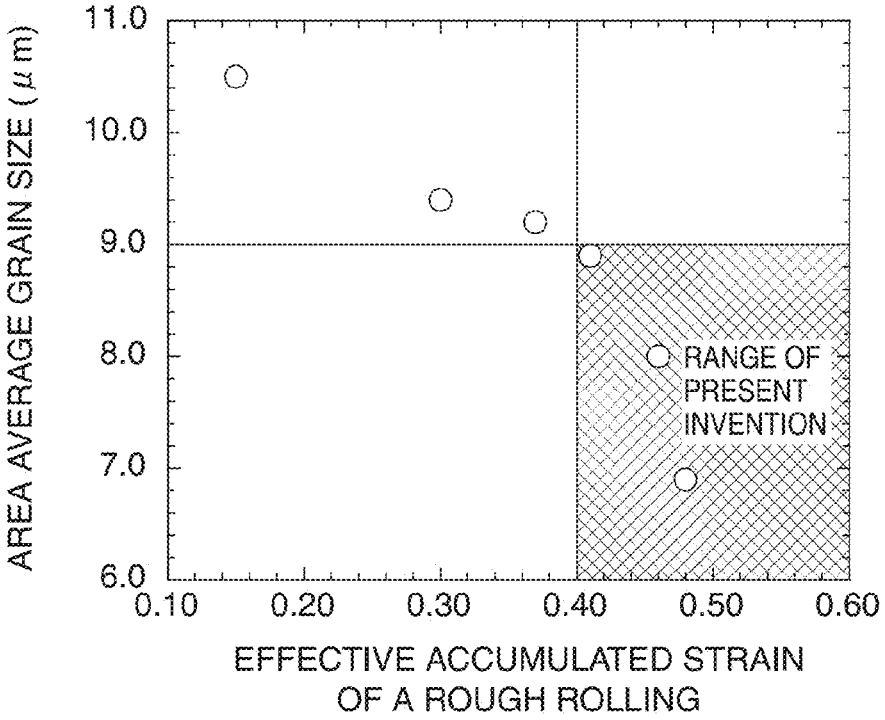
FIG. 9 is a view representing a relationship between a rough effective accumulated strain and the area average grain size.
Figure 10:
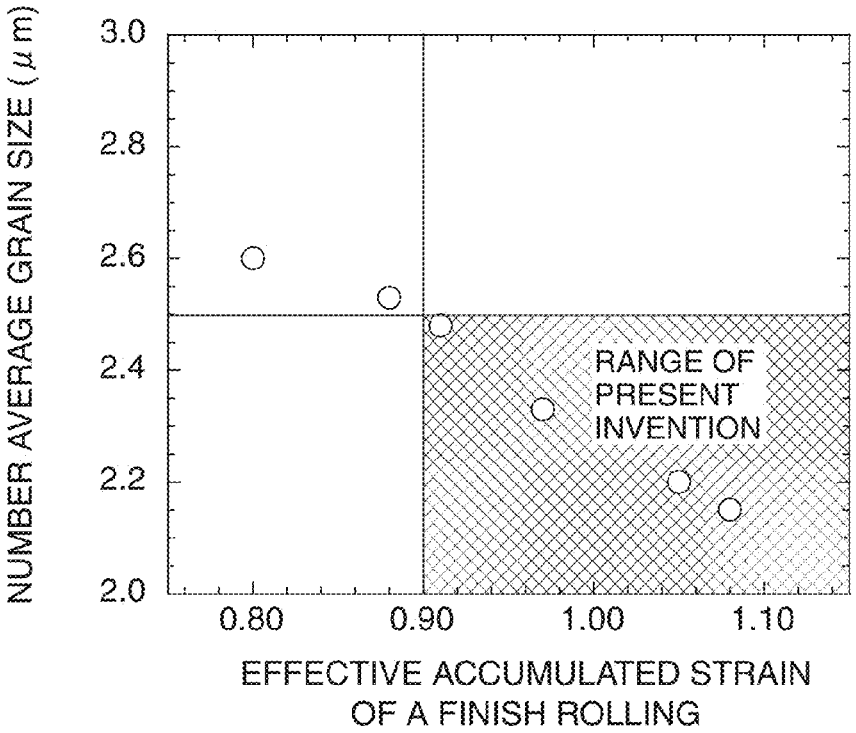
FIG. 10 is a view representing a relationship between a finish effective accumulated strain and the number average grain size.

A relationship between a rough effective accumulated strain and the area average grain size is represented in FIG. 9, and a relationship between a finish effective accumulated strain and the number average grain size are represented in FIG. 10. Namely, as it is obvious from FIG. 9, the recrystallization austenite just before the non-recrystallization region rolling is refined and the aimed toughness can be obtained when the effective accumulated strain ($\epsilon_{eff}$) of the rough rolling is 0.4 or more. The effective accumulated strain ($\epsilon_{eff}$) of the rough rolling is desirable to be 0.6 or less from a point of view of durability of the rough rolling mill caused by the rolling weight load in the rough rolling.

Figure 11A:
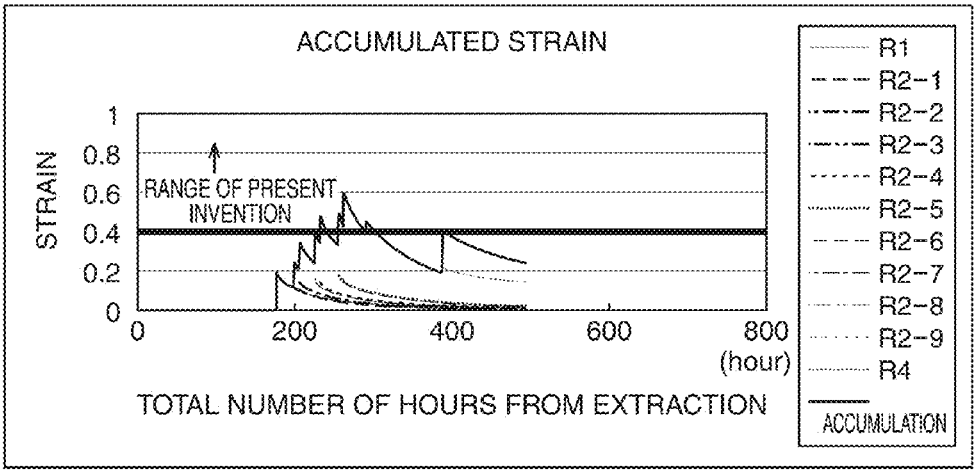
FIG. 11A is a property chart representing a relationship of an effective accumulated strain ($\epsilon_{eff}$) of a rough rolling with a total number of hours (rough rolling pass schedule) from extraction as for Pattern 1.
Figure 11B:
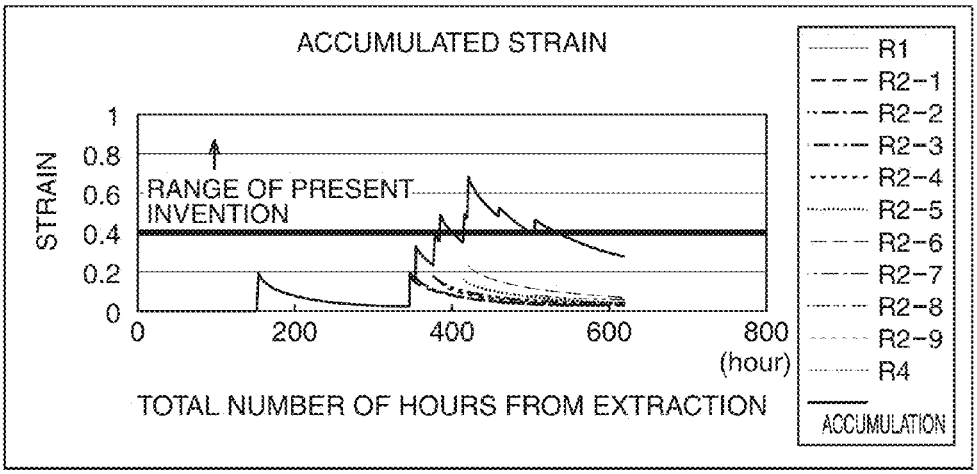
FIG. 11B is a property chart representing a relationship of the effective accumulated strain ($\epsilon_{eff}$) of the rough rolling with the total number of hours (rough rolling pass schedule) from the extraction as for Pattern 2.
Figure 11C:
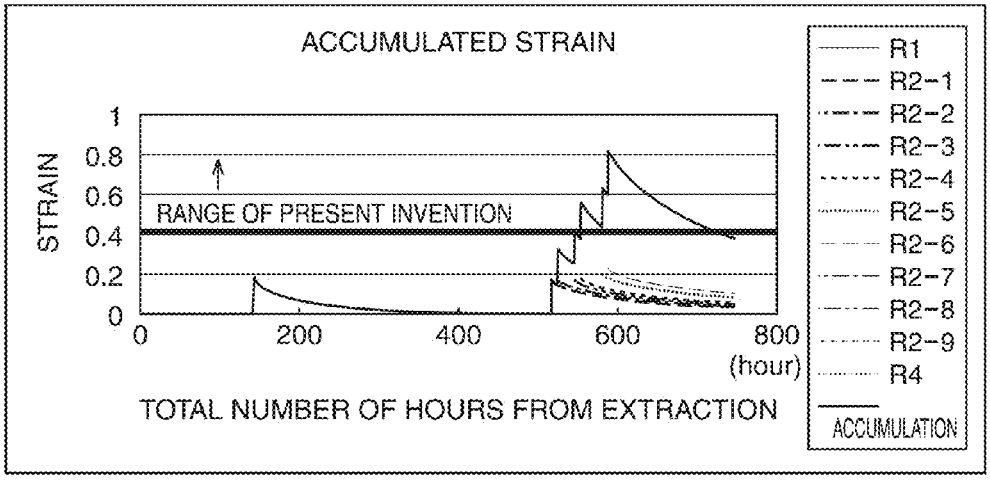
FIG. 11C is a property chart representing a relationship of the effective accumulated strain ($\epsilon_{eff}$) of the rough rolling with the total number of hours (rough rolling pass schedule) from the extraction as for Pattern 3.
Figure 11D:
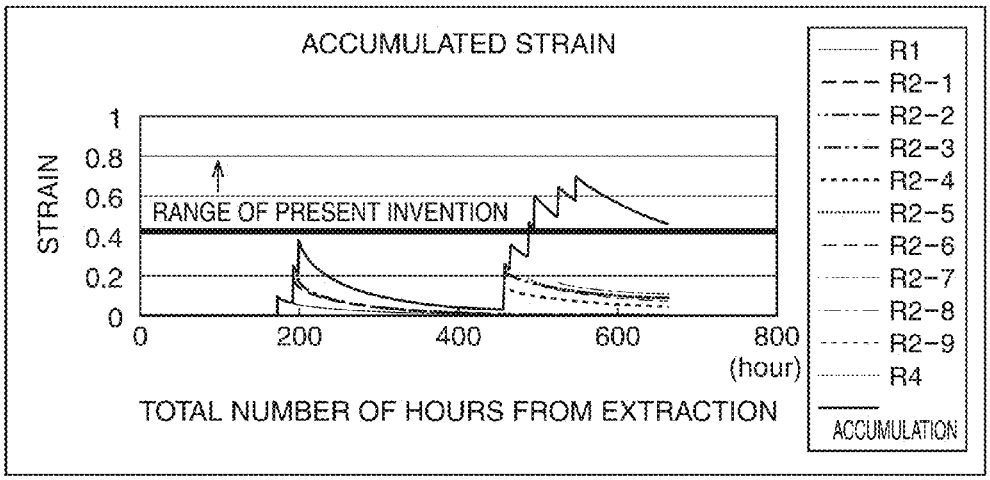
FIG. 11D is a property chart representing a relationship of the effective accumulated strain ($\epsilon_{eff}$) of the rough rolling with the total number of hours (rough rolling pass schedule) from the extraction as for Pattern 4.

A relationship of the effective accumulated strain ($\epsilon_{eff}$) of the rough rolling with a total number of hours from extraction (rough rolling pass schedule) is represented in each of FIG. 11A to FIG. 11D. In FIG. 11A to FIG. 11D, patterns of the rough rolling are different, and the rolling time, a temperature of a rough bar, the effective accumulated strain are each different. FIG. 11A represents a pattern 1, FIG. 11B represents a pattern 2, FIG. 11C represents a pattern 3, and FIG. 11D represents a pattern 4, respectively. In FIG. 11A to FIG. 11D, R1, R2, R4 represent passes of the rough rolling mill. Only the R2 is the reverse rolling mill, and therefore, the rolling at odd number of times such as R2-1 to R2-9 are performed. The $\epsilon_{eff}$ introduced in each pass attenuate by a function of an accumulated time t and a rolling temperature T in accordance with the above-stated expression (2), and the effective accumulated strain ($\epsilon_{eff}$) is obtained by adding each $\epsilon_{eff}$.

In the present invention, the $E_{eff}$ is set to be 0.4 or more as stated above. In the pattern 1 (comparative example), productivity (the total number of hours from the extraction) is thought more important than the $E_{eff}$, and in the pattern 3 (comparative example), the $E_{eff}$ is thought more important than the productivity. In the pattern 2 (comparative example), when waiting for temperature to drop is performed at an initial phase of the rolling pass, it takes long time until the temperature is lowered because the rough bar is thick, and the productivity is lowered. On the other hand, when the waiting is performed at a position where the rough bar is thin, it is possible to cool the rough bar within a short period of time, but the effective accumulated strain up to that time attenuates, and the effective accumulated strain as a whole becomes lower than 0.4 which is defined in the present invention. In the pattern 4 (example of the present invention), the productivity and the $E_{eff}$ are both enabled, and the $E_{eff}$ defined in the present invention is set as the index at the rough rolling, and thereby, it becomes possible to optimize both the productivity and the accumulated strain.

The recrystallization temperature region rolling at the rough rolling process is performed, but the rolling reduction ratio in each rolling reduction pass is not limited in the present invention. Note that enough strain necessary for recrystallization is not introduced, the grain growth resulting from only grain boundary migration occurs, a coarse grain is generated, and there is a possibility in which the low-temperature toughness deteriorates if the rolling reduction ratio at each pass of the rough rolling is 10% or less, and therefore, it is desirable to perform the rolling with the rolling reduction ratio of more than 10% in each rolling reduction pass at the recrystallization temperature region. Similarly, when the rolling reduction ratio in each rolling reduction pass at the recrystallization temperature region is 25% or more, a dislocation cell wall is formed by repeating introduction of dislocation and recovery during the rolling reduction time particularly at a low-temperature region at a subsequent stage, and a dynamic recrystallization changing from a subgrain boundary to a high-angle grain boundary occurs, but the grain growth occurs in a short period of time in a structure in which a grain of which dislocation density is high and a grain of which dislocation density is not high are mixed such as a microstructure of which main body is the dynamic recrystallization grains, and therefore, they grow into a relatively coarse grains before the non-recrystallization region rolling, the grains are generated by the subsequent non-recrystallization region rolling, and there is a possibility in which the low-temperature toughness deteriorates, therefore, it is desirable to set the rolling reduction ratio in each rolling reduction pass at the recrystallization temperature region to be less than 25%. Besides, the time waiting may be performed until the temperature is lowered to the non-recrystallization temperature region, or cooling by a cooling device may be performed. The latter one is able to reduce the time for the time waiting, and therefore, it is more desirable from a point of view of the productivity.

On the other hand, as it is obvious from the relationship between the effective accumulated strain of the finish rolling and the number average grain size represented in FIG. 10, it is possible to obtain the aimed toughness by a controlled rolling effect at the finish rolling to be the non-recrystallization region rolling when the effective accumulated strain of the finish rolling is 0.9 or more.

Here, the effective accumulated strain of the finish rolling is desirable to be 1.2 or less from a point of view of durability of the finish rolling mill resulting from the rolling weight load at the finish rolling.

In this finish rolling process, the rolling reduction ratio in each rolling reduction pass is not limited in the present invention. In the rolling at the non-recrystallization temperature region, the time waiting is performed until the temperature is lowered to the non-recrystallization temperature region according to need, or the cooling by the cooling device may be performed according to need between the rough/finish rolling stands, when the temperature at the rough rolling end time does not reach the non-recrystallization temperature region. The latter one is more desirable because it is possible to reduce the time for the time waiting, and therefore, not only the productivity improves but also the growth of the recrystallization grain is suppressed, and the low-temperature toughness can be improved.

Note that when a total rolling reduction ratio of the finish rolling exceeds 85%, the dislocation density to be the nucleus of the ferrite transformation increases by the excessive rolling, a generation amount of the pro-eutectoid ferrite increases too much in the microstructure. Besides, the precipitation strengthening of Nb becomes overaging to lower the strength caused by the ferrite transformation at the high-temperature, and there is fear that anisotropy of the texture after the transformation becomes remarkable resulting from a crystal rotation to increase plastic anisotropy and the lowering of the absorption energy caused by the occurrence of the separation is incurred, and therefore, the total rolling reduction ratio of the non-recrystallization temperature region is set to be 85% or less.

The rolling reduction ratio at a final stand is desirable to be less than 15% from a point of view of a plate shape accuracy.

Further, it turns out that when a product of the effective accumulated strain of the rough rolling and the effective accumulated strain of the finish rolling is 0.38 or more, aiming a synergistic effect of these, it becomes a necessary and sufficient condition to obtain the aimed toughness. The above-stated product is desirable to be 0.72 or less from a point of view of the durability of the rolling mill caused by the rolling weight load at the rough and finish rolling. Here, the effective accumulated strain of the rough rolling is the crystal grain size of the recrystallization austenite, namely, it is one of the indexes determining the crystal grain size (area average grain size) of the steel sheet. The finish effective accumulated strain is an index at an accumulated rolling reduction ratio at the non-recrystallization region (there is a correlation with the dislocation density before transformation), and it is also the index determining the crystal grain size (number average grain size) of the steel sheet. It is necessary to define the lower limit values for each of these effective accumulated strains, and when the product is 0.38 or less, the aimed crystal grain size cannot be obtained.

Figure 2:
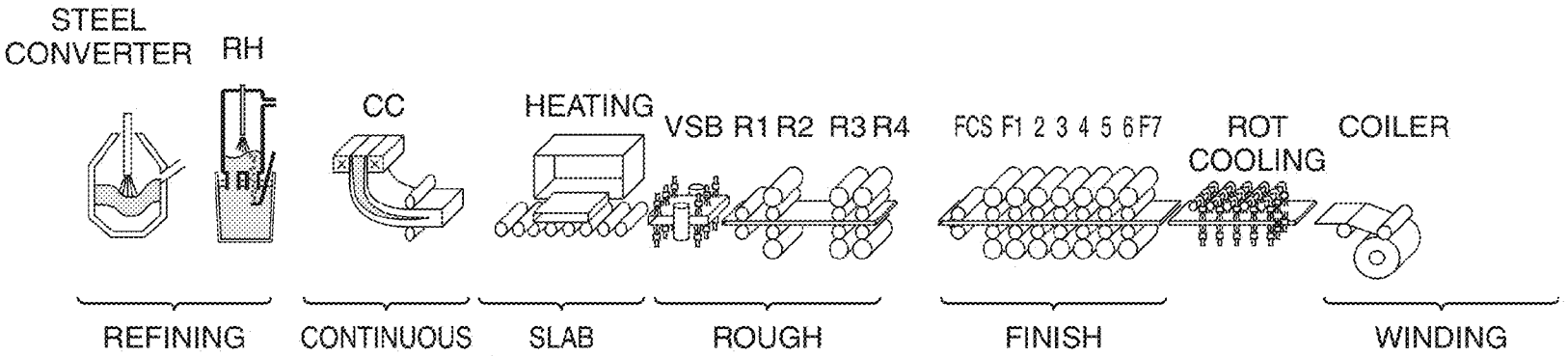
FIG. 2 is a process chart illustrating an example of respective processes manufacturing a hot coil being a material of an electric resistance welded steel pipe and a spiral steel pipe being an object of the present invention.

Here, the non-recrystallization temperature region is able to be estimated from a relationship between an Nb content and a non-recrystallization upper limit temperature described in, for example, FIG. 2 of Thermomechanical Processing of Microalloyed Austenite Page 129; The Effect of Microalloy Concentration on The Recrystallization of Austenite During Hot Deformation (1982 The Metallurgical Society of AIME).

Further, a single or plural rough bars are bonded between the rough rolling and the finish rolling, and the finish rolling may be continuously performed. At this time, the rough bar may be once winded in a coil state, it is stored in a cover having a heat insulating function according to need, and it is rewound again to perform the bonding.

The finish rolling end temperature is set to end at the Ar3 transformation point temperature or more. In particular, when the temperature becomes less than the Ar3 transformation point temperature at a sheet thickness center side than a sheet thickness of ½ t, the effect of the crystallographic colonies of {111} and {100} distributed in a band state increases, the value of the reflected X-ray intensity ratio {211}/{111} of the {211} plane and the {111} plane becomes less than 1.1, the plastic anisotropy of the crystallographic colonies becomes remarkable, outstanding separation occurs at the ductile fracture surface, the absorption energy is remarkably lowered, and therefore, the finish rolling end temperature is set to end at the Ar3 transformation point temperature or more at the sheet thickness of ½ t. It is more desirable if it is 830° C. or more, then the occurrence of the separation can be suppressed for some extent. Besides, it is desirable to set the sheet surface temperature at the Ar3 transformation point temperature or more. On the other hand, when it exceeds 870° C., the dislocation density to be the transformation nucleus decreases by the recovery between the passes, the grain refining effect is lost, and there is fear that the low-temperature toughness deteriorates. Accordingly, it is desirable to end the rolling within a temperature range of 830° C. to 870° C.

Here, the $Ar_3$ transformation point temperature is simply represented by a relationship with the steel components by, for example, the following calculation expression.

$$Ar_3=910-310\times\%\ C+25\times\%\ Si-80\times\%\ Mneq$$

Note that, Mneq=Mn+Cr+Cu+Mo+Ni/2+10 (Nb−0.02)

Otherwise, Mneq=Mn+Cr+Cu+Mo+Ni/2+10 (Nb−0.02)+1: in case when B is added.

After the finish rolling ends, the cooling starts. A cooling start temperature is not particularly limited, but when the cooling is started from less than the $Ar_3$ transformation point temperature, the average crystal grain size is coarse caused by the grain growth, and there is fear of the lowering of the strength, and therefore, the cooling start temperature is desirable to be the $Ar_a$ transformation point temperature or more.

The cooling rate at a temperature region from the cooling start to 650° C. is set to be 2° C./sec or more and 50° C./sec or less. When it exceeds 650° C., the precipitation of Nb strengthening the pro-eutectoid ferrite becomes overaging to lower the strength. When the cooling rate is less than 2°

C./sec, the average crystal grain size is coarse caused by the grain growth, and there is fear that the strength is lowered. On the other hand, when the cooling rate exceeds 50° C./sec, plate warp caused by thermal strain is feared, and therefore, it is set to be 50° C./sec or less.

The cooling rate at a temperature region from 650° C. to the winding time is sufficient to be a cooling rate of air cooling or the cooling rate equivalent thereto. Note that it is desirable that the average cooling rate from 650° C. to the winding time is 5° C./sec or more so that the precipitates do not become overaging caused by the coarseness to enjoy the effect of the precipitation strengthening of Nb and so on at the maximum.

After the cooling, the winding process being the characteristic of the hot coil manufacturing process is effectively used. A cooling stop temperature and a winding temperature is set to be a temperature region of 520° C. or more and 620° C. or less. When the cooling is stopped at more than 620° C. and the winding is performed after that, the precipitates of Nb become overaging and the precipitation strengthening is not fully expressed. Besides, the coarse carbonitride containing Nb and so on is formed to be the starting point of fracture, and there is a possibility that the ductile fracture stop ability, the low-temperature toughness, and the sour-resistant property are deteriorated. On the other hand, when the cooling is ended at less than 520° C. and the winding is performed, the fine carbide precipitates of Nb and so on which is extremely effective to obtain the aimed strength cannot be obtained, and as a result, the aimed strength cannot be obtained. Accordingly, the temperature region to stop the cooling and start the winding is set to be 520° C. or more and 620° C. or less.

EXAMPLE

Hereinafter, the present invention is further described by examples.

Steels of A to K having chemical components represented in Table. 2 are produced by a steel converter, and a secondary refining is performed by CAS or RH. A deoxidation process is performed at the secondary refining process. These steels are direct rolled or reheated after the continuous casting, it is reduced by rolling to be the sheet thickness of 18.4 mm by the finish rolling subsequent to the rough rolling, and wound after the cooling on the run-out-table. Note that the chemical components in the table are represented by mass %.

TABLE 2

| | CHEMICAL COMPONENT (UNIT: MASS %) | | | | | | | | | | |
|---|---|---|---|---|---|---|---|---|---|---|---|
| STEEL | C | Si | Mn | P | S | O | Al | N | Nb | Ti | Y |
| A | 0.045 | 0.14 | 1.64 | 0.008 | 0.0009 | 0.0019 | 0.021 | 0.0040 | 0.075 | 0.013 | 0.051 |
| B | 0.044 | 0.14 | 1.63 | 0.008 | 0.0009 | 0.0019 | 0.023 | 0.0042 | 0.074 | 0.014 | 0.050 |
| C | 0.058 | 0.31 | 1.49 | 0.011 | 0.0014 | 0.0021 | 0.026 | 0.0033 | 0.096 | 0.010 | 0.046 |
| D | 0.041 | 0.36 | 1.79 | 0.013 | 0.0018 | 0.0028 | 0.022 | 0.0041 | 0.110 | 0.013 | 0.070 |
| E | 0.028 | 0.07 | 1.92 | 0.009 | 0.0007 | 0.0029 | 0.028 | 0.0019 | 0.055 | 0.006 | 0.051 |
| F | 0.071 | 0.19 | 1.52 | 0.010 | 0.0012 | 0.0027 | 0.011 | 0.0044 | 0.085 | 0.013 | 0.040 |
| G | 0.050 | 0.28 | 1.60 | 0.012 | 0.0016 | 0.0022 | 0.029 | 0.0028 | 0.046 | 0.009 | 0.070 |
| H | 0.047 | 0.22 | 1.65 | 0.011 | 0.0038 | 0.0020 | 0.020 | 0.0031 | 0.077 | 0.010 | 0.063 |
| I | 0.044 | 0.25 | 1.66 | 0.010 | 0.0010 | 0.0029 | 0.012 | 0.0038 | 0.071 | 0.004 | 0.040 |
| J | 0.047 | 0.22 | 1.63 | 0.010 | 0.0010 | 0.0031 | 0.011 | 0.0041 | 0.051 | 0.019 | 0.040 |
| K | 0.055 | 0.20 | 2.13 | 0.009 | 0.0011 | 0.0011 | 0.024 | 0.0044 | 0.052 | 0.013 | 0.010 |

| | CHEMICAL COMPONENT (UNIT: MASS %) | | | | | |
|---|---|---|---|---|---|---|
| STEEL | Mo | Ca | S/Ca | N * ※ | OTHERS | REMARKS |
| A | 0.20 | 0.0024 | 0.38 | 0.0002 | Cr: 0.11% Cu: 0.2%, Ni: 0.19%, REM: 0.0020% | PRESENT INVENTION |
| B | 0.20 | 0.0022 | 0.41 | 0.0001 | Cr: 0.11% Cu: 0.2%, Ni: 0.19% | PRESENT INVENTION |
| C | 0.20 | 0.0027 | 0.52 | 0.0004 | B: 0.0008% | PRESENT INVENTION |
| D | 0.15 | 0.0019 | 0.95 | 0.0003 | | PRESENT INVENTION |
| E | 0.14 | 0.0008 | 0.88 | 0.0002 | Cr: 0.15% Cu: 0.27%, Ni: 0.15% | PRESENT INVENTION |
| F | 0.18 | 0.0020 | 0.60 | 0.0006 | | COMPARATIVE STEEL |
| G | 0.21 | 0.0022 | 0.73 | 0.0002 | | COMPARATIVE STEEL |
| H | 0.19 | 0.0002 | 19.00 | 0.0002 | | COMPARATIVE STEEL |
| I | 0.21 | 0.0018 | 0.56 | 0.0026 | | COMPARATIVE STEEL |
| J | 0.21 | 0.0016 | 0.63 | −0.0014 | | COMPARATIVE STEEL |
| K | 0.03 | 0.0039 | 0.28 | 0.0006 | | COMPARATIVE STEEL |

Detailed manufacturing conditions are represented in Table 3. Here, a "component" represents a symbol of each cast slab represented in Table 2, an "electromagnetic stirring+soft reduction" represents presence/absence of the "electromagnetic stirring" and the "soft reduction" performed at the continuous casting time to reduce the central segregation, a "heating temperature" means a slab heating temperature actual performance, a "solution temperature" means a temperature calculated by the expression: SRT (° C.)=6670/(2.26−log [% Nb] [% C]−273, a "retention time" means a retention time at the actual performance slab heating temperature, a "rough effective accumulated strain" means the effective accumulated strain of the rolling performed by the rough rolling calculated by the following (2) expression, a "bar cooling" means presence/absence of a cooling between rolling stands aimed to be appropriately performed in accordance with the rolling conditions, a "finish effective accumulated strain" means the effective accumulated strain of the rolling performed by the finish rolling calculated by the following (2) expression, a "product of rough and finish" means the product of each effective accumulated strain of the rolling performed by the finish rolling and the rough rolling. The effective accumulated strain ($\epsilon_{eff}$) is calculated by the following expression (2).

$$E_{eff}=\Sigma\epsilon_i(t,T)\epsilon_i(t,T)=\epsilon_{i0}/\exp\{(t/\tau_R)^{2/3}\}$$

$$T_R=\tau_0\cdot\exp(Q/RT)\tau_0=8.46\times10^{-6}$$

$$Q=183200J\ R=8.314J/K\cdot\text{mol} \quad (2),$$

An "FT" means a finish rolling end temperature, an "Ar3 transformation point temperature" means the calculated Ar3 transformation point temperature, a "cooling rate to 650° C." means the average cooling rate when the temperature region from the cooling start temperature to 650° C. is passed, and a "CT" means a winding temperature.

TABLE 3

| | MANUFACTURING CONDITION | | | | | | |
|---|---|---|---|---|---|---|---|
| STEEL NUMBER | COMPONENT | ELECTROMAGNETIC STIRRING + SOFT REDUCTION | SOLUTION TEMPERATURE (° C.) | HEATING TEMPERATURE (° C.) | RETENTION TIME (min) | ROUGH EFFECTIVE ACCUMULATED STRAIN | BAR COOLING |
| 1 | A | PRESENT | 1137 | 1200 | 30 | 0.42 | ABSENT |
| 2 | A | ABSENT | 1137 | 1200 | 30 | 0.42 | ABSENT |
| 3 | B | ABSENT | 1137 | 1200 | 30 | 0.42 | ABSENT |
| 4 | B | ABSENT | 1132 | 1050 | 30 | 0.42 | ABSENT |
| 5 | B | ABSENT | 1132 | 1200 | 5 | 0.42 | ABSENT |
| 6 | B | ABSENT | 1132 | 1200 | 30 | 0.18 | ABSENT |
| 7 | B | ABSENT | 1132 | 1200 | 30 | 0.42 | ABSENT |
| 8 | B | ABSENT | 1132 | 1200 | 30 | 0.41 | ABSENT |
| 9 | B | ABSENT | 1132 | 1200 | 30 | 0.42 | ABSENT |
| 10 | B | ABSENT | 1132 | 1200 | 30 | 0.42 | ABSENT |
| 11 | B | ABSENT | 1132 | 1200 | 30 | 0.42 | ABSENT |
| 12 | B | ABSENT | 1132 | 1200 | 30 | 0.42 | ABSENT |
| 13 | C | ABSENT | 1205 | 1230 | 60 | 0.55 | PRESENT |
| 14 | D | ABSENT | 1175 | 1230 | 60 | 0.45 | ABSENT |
| 15 | E | ABSENT | 1042 | 1200 | 60 | 0.61 | ABSENT |
| 16 | F | ABSENT | 1216 | 1250 | 60 | 0.45 | ABSENT |
| 17 | G | ABSENT | 1089 | 1200 | 60 | 0.45 | ABSENT |
| 18 | H | ABSENT | 1146 | 1200 | 60 | 0.45 | ABSENT |
| 19 | I | ABSENT | 1127 | 1200 | 60 | 0.45 | ABSENT |
| 20 | J | ABSENT | 1094 | 1200 | 60 | 0.45 | ABSENT |
| 21 | K | ABSENT | 1116 | 1200 | 60 | 0.45 | ABSENT |

| | MANUFACTURING CONDITION | | | | | | |
|---|---|---|---|---|---|---|---|
| STEEL NUMBER | FINISH EFFECTIVE ACCUMULATED STRAIN | PRODUCT OF ROUGH-FINISH | Ar3 TRANSFORMATION POINT TEMPERATURE (° C./sec) | FT (° C.) | COOLING RATE (° C./sec) | CT (° C.) | REMARKS |
| 1 | 1.12 | 0.47 | 677 | 820 | 8 | 570 | PRESENT INVENTION |
| 2 | 1.12 | 0.47 | 677 | 820 | 8 | 570 | PRESENT INVENTION |
| 3 | 1.12 | 0.47 | 677 | 820 | 8 | 570 | PRESENT INVENTION |
| 4 | 1.12 | 0.47 | 678 | 820 | 8 | 570 | COMPARATIVE STEEL |
| 5 | 1.12 | 0.47 | 678 | 800 | 8 | 570 | COMPARATIVE STEEL |
| 6 | 1.12 | 0.20 | 678 | 820 | 8 | 570 | COMPARATIVE STEEL |
| 7 | 0.75 | 0.32 | 678 | 820 | 8 | 570 | COMPARATIVE STEEL |
| 8 | 0.91 | 0.37 | 678 | 820 | 8 | 570 | COMPARATIVE STEEL |
| 9 | 1.12 | 0.47 | 678 | 650 | 12 | 570 | COMPARATIVE STEEL |
| 10 | 1.12 | 0.47 | 678 | 820 | 1 | 570 | COMPARATIVE STEEL |
| 11 | 1.12 | 0.47 | 678 | 820 | 8 | 680 | COMPARATIVE STEEL |
| 12 | 1.12 | 0.47 | 678 | 820 | 30 | 570 | PRESENT INVENTION |
| 13 | 1.04 | 0.57 | 704 | 840 | 12 | 550 | PRESENT INVENTION |

TABLE 3-continued

| | | | | | | | |
|---|---|---|---|---|---|---|---|
| 14 | 1.06 | 0.48 | 679 | 820 | 21 | 550 | PRESENT INVENTION |
| 15 | 0.98 | 0.60 | 671 | 810 | 26 | 600 | PRESENT INVENTION |
| 16 | 1.06 | 0.48 | 705 | 780 | 12 | 550 | COMPARATIVE STEEL |
| 17 | 1.06 | 0.48 | 736 | 780 | 12 | 550 | COMPARATIVE STEEL |
| 18 | 1.06 | 0.48 | 708 | 780 | 12 | 550 | COMPARATIVE STEEL |
| 19 | 1.06 | 0.48 | 712 | 780 | 12 | 550 | COMPARATIVE STEEL |
| 20 | 1.06 | 0.48 | 729 | 780 | 12 | 550 | COMPARATIVE STEEL |
| 21 | 1.06 | 0.48 | 700 | 780 | 12 | 550 | COMPARATIVE STEEL |

Materials of the steels obtained as stated above are represented in Table 4. Investigation methods are illustrated in the following.

The tensile test is performed by cutting out the No. 5 test piece described in JIS Z 2201 from the R direction, in accordance with the method of JIS Z 2241. The Charpy impact test is performed by cutting out the test piece described in JIS Z 2202 from the R direction of the sheet thickness center, in accordance with the method of JIS Z 2242.

The DWTT (Drop Weight Tear Test) test is performed by cutting out a strip test piece of 300 mmL×75 mmW×sheet thickness (t) mm from the R direction, and manufacturing the test piece in which the press-notch of 5 mm is performed for the cut out strip test piece.

Next, at first the EBSP-OIM™ (Electron Back Scatter Diffraction Pattern-Orientation Image Microscopy) is used to measure the crystal grain size and the microstructure from the micro samples cut out from each of the DWTT test pieces after the test as illustrated in prior FIG. 3. The sample is polished with the colloidal silica abrasive for 30 minutes to 60 minutes, and the EBSP measurement is performed under the measurement conditions of the magnification of 400 times, 160 μm×256 μm area, and the measurement step of 0.5 μm.

Besides, the pro-eutectoid ferrite volume fraction is found as for the microstructure by the Kernel Average Misorientation (KAM) method being equipped with the EBSP-OIM™.

Further, as for the measurement of the maximum Mn segregation amount, the Mn concentration distribution of the product sheet is measured by an EPMA (Electron Probe Micro Analyzer), or a CMA (Computer Aided Micro Analyzer) capable of image processing of the measurement result by the EPMA. The probe diameter is set to be 2 μm, and the measurement range is the area of at least 1 mm in the sheet thickness direction and 3 mm in the sheet width direction of the central segregation portion of the product sheet center.

In the central segregation portion of Mn measured as stated above, the area of 1 mm in the sheet thickness direction, 3 mm in the sheet width direction is measured by the micro Vickers hardness tester at 25 g×15 seconds with 50 μm pitch centering on the central segregation portion. The average value in the sheet width direction at each sheet thickness direction position is set as the average base material hardness, and the average value in the sheet width direction of the maximum hardness of the central segregation portion among the hardness is defined as the maximum hardness.

In Table 4, the "microstructure" means the microstructure at ½ t of the micro sample cut out from each DWTT test piece after the test. The "maximum Mn segregation amount" among them is the value measured by the above-stated method in the corresponding sample, the "pro-eutectoid ferrite volume fraction" means the value measured by the KAM method of the EBSP-OIM™, the "number average grain size", the "area average grain size", and the "standard deviation" similarly mean the measurement results by the EBSP-OIM™.

The "tensile test" result represents the result of the R direction JIS No. 5 test piece, the "SA (−20° C.)" is the ductile fracture rate in the DWTT test at −20° C., the "separation index" similarly represents the separation index of the fracture surface in the DWTT test at −20° C., the "absorption energy vE −20° C." is the absorption energy obtained at −20° C. in the Charpy impact test.

TABLE 4

| | MICROSTRUCTURE | | | | | | | |
|---|---|---|---|---|---|---|---|---|
| STEEL NUMBER | MAXIMUM Mn SEGREGATION DEGREE (%) | HARDNESS (Hv) | SEGREGATION WIDTH (μm) | PRO-EUTECTOID FERRITE VOLUME FRACTION (%) | NUMBER AVERAGE GRAIN SIZE (μm) | AREA AVERAGE GRAIN SIZE (μm) | STANDARD DEVIATION (μm) | SURFACE INTENSITY RATIO |
| 1 | 1.64 | 244 | 0 | 6 | 2.2 | 8.3 | 2.1 | 1.2 |
| 2 | 1.84 | 311 | 220 | 8 | 2.3 | 6.5 | 1.9 | 1.2 |
| 3 | 1.77 | 289 | 160 | 7 | 2.3 | 6.9 | 2.0 | 1.2 |
| 4 | 1.77 | 291 | 180 | 12 | 2.6 | 10.5 | 2.7 | 1.1 |
| 5 | 1.73 | 285 | 160 | 16 | 2.6 | 10.7 | 2.6 | 1.3 |
| 6 | 1.74 | 286 | 190 | 3 | 2.6 | 11.0 | 2.8 | 1.1 |
| 7 | 1.74 | 280 | 180 | 4 | 2.8 | 9.1 | 2.6 | 1.2 |
| 8 | 1.78 | 290 | 160 | 4 | 2.6 | 9.4 | 2.7 | 1.2 |
| 9 | 1.78 | 294 | 160 | 18 | 2.5 | 8.7 | 2.0 | 0.8 |
| 10 | 1.79 | 298 | 140 | 19 | 2.6 | 9.7 | 2.5 | 1.1 |
| 11 | 1.81 | 303 | 120 | 17 | 2.5 | 9.0 | 2.2 | 1.2 |

TABLE 4-continued

| | | | | | | | | |
|---|---|---|---|---|---|---|---|---|
| 12 | 1.87 | 320 | 160 | 4 | 2.1 | 7.0 | 2.1 | 1.1 |
| 13 | 1.54 | 261 | 60 | 9 | 2.1 | 6.4 | 2.0 | 1.2 |
| 14 | 1.92 | 331 | 190 | 14 | 2.2 | 6.8 | 1.9 | 1.4 |
| 15 | 1.98 | 344 | 240 | 12 | 2.4 | 8.1 | 2.0 | 1.3 |
| 16 | 1.70 | 260 | 140 | 1 | 2.4 | 8.8 | 2.1 | 1.1 |
| 17 | 1.75 | 270 | 120 | 10 | 2.7 | 9.6 | 2.6 | 1.1 |
| 18 | 1.79 | 268 | 140 | 17 | 2.4 | 8.2 | 2.2 | 1.2 |
| 19 | 1.71 | 257 | 120 | 14 | 2.7 | 12.6 | 2.7 | 1.2 |
| 20 | 1.80 | 290 | 100 | 15 | 2.2 | 8.4 | 2.1 | 1.1 |
| 21 | 2.33 | 371 | 260 | 3 | 2.4 | 8.9 | 2.2 | 1.2 |

| | MECHANICAL PROPERTIES | | | | | | |
|---|---|---|---|---|---|---|---|
| | | | | TOUGHNESS EVALUATION TEST | | | |
| | TENSILE TEST (R DIRECTION) | | | DWTT | | CHARPY ABSORPTION ENERGY | |
| STEEL NUMBER | YP (MPa) | TS (MPa) | El (%) | SA (−20° C.) (° C.) | SEPARATION INDEX (mm/mm2) | (vE−20° C.) (J) | REMARKS |
| 1 | 662 | 744 | 35.4 | 100 | 0.000 | 303 | PRESENT INVENTION |
| 2 | 668 | 749 | 35.0 | 96 | 0.048 | 292 | PRESENT INVENTION |
| 3 | 670 | 746 | 34.4 | 100 | 0.028 | 282 | PRESENT INVENTION |
| 4 | 561 | 678 | 38.4 | 78 | 0.028 | 282 | COMPARATIVE STEEL |
| 5 | 549 | 682 | 38.2 | 84 | 0.120 | 242 | COMPARATIVE STEEL |
| 6 | 670 | 746 | 34.4 | 33 | 0.005 | 280 | COMPARATIVE STEEL |
| 7 | 672 | 755 | 35.0 | 28 | 0.015 | 274 | COMPARATIVE STEEL |
| 8 | 647 | 749 | 34.8 | 24 | 0.018 | 241 | COMPARATIVE STEEL |
| 9 | 698 | 768 | 29.0 | 100 | 0.191 | 198 | COMPARATIVE STEEL |
| 10 | 671 | 762 | 32.4 | 44 | 0.022 | 241 | COMPARATIVE STEEL |
| 11 | 541 | 646 | 40.3 | 85 | 0.059 | 243 | COMPARATIVE STEEL |
| 12 | 606 | 731 | 36.1 | 100 | 0.013 | 326 | PRESENT INVENTION |
| 13 | 620 | 719 | 37.0 | 100 | 0.022 | 300 | PRESENT INVENTION |
| 14 | 634 | 731 | 36.0 | 100 | 0.051 | 284 | PRESENT INVENTION |
| 15 | 614 | 708 | 37.6 | 90 | 0.033 | 277 | PRESENT INVENTION |
| 16 | 695 | 787 | 33.2 | 86 | 0.087 | 166 | COMPARATIVE STEEL |
| 17 | 587 | 679 | 38.0 | 68 | 0.011 | 245 | COMPARATIVE STEEL |
| 18 | 641 | 733 | 36.1 | 31 | 0.000 | 240 | COMPARATIVE STEEL |
| 19 | 612 | 700 | 37.5 | 77 | 0.042 | 244 | COMPARATIVE STEEL |
| 20 | 620 | 716 | 37.0 | 46 | 0.037 | 240 | COMPARATIVE STEEL |
| 21 | 703 | 816 | 31.2 | 66 | 0.112 | 203 | COMPARATIVE STEEL |

The steels according to the present invention are seven steels having the steel numbers 1, 2, 3, 12, 13, 14, and 15. They have characteristics in which a predetermined amount of steel components are contained, the pro-eutectoid ferrite fraction is 3% or more and 20% or less and the other is the low-temperature transformation phase in the microstructure, the number average crystal grain size of the whole of the microstructure is 2.5 μm or less, the area average grain size is 9 μm or less, and the standard deviation thereof is 2.3 μm or less, and the reflected X-ray intensity ratio {211}/{111} of the plane and the {111} plane which are in parallel to the sheet surface of the sheet thickness center portion is 1.1 or more. The high-strength hot-rolled steel sheet for the spiral pipe having the tensile strength equivalent to X80 grade and excellent in the low-temperature toughness is obtained as the material before the tubulization.

The steels other than the above are out of the range of the present invention according to the reasons described below.

In the steel number 4, the heating temperature is out of the range of the present invention, and therefore, the tensile strength equivalent to X80 grade cannot be obtained, and further, the SA (−20° C.) is low because the solution of Nb is insufficient.

In the steel number 5, the heat retention time is out of the range of the present invention, and therefore, the tensile strength equivalent to X80 grade cannot be obtained, and further, the SA (−20° C.) is low because the solution of Nb is insufficient.

In the steel number 6, the rough effective accumulated strain is out of the range of the present invention, and therefore, the aimed microstructure cannot be obtained, and the SA (−20° C.) is low.

In the steel number 7, the finish effective accumulated strain is out of the range of the present invention, and therefore, the aimed microstructure cannot be obtained, and the SA (−20° C.) is low.

In the steel number 8, the product of the rough effective accumulated strain and the finish effective accumulated strain is out of the range of the present invention, and therefore, the aimed microstructure cannot be obtained, and the SA (−20° C.) is low.

In the steel number 9, the finish rolling temperature is the Ar3 transformation point or less to incur the two-phase region rolling, and therefore, the surface intensity ratio is out of the range of the present invention, and the occurrence of the separation is remarkable.

In the steel number 10, the cooling rate is out of the range of the present invention, and therefore, the grain growth occurs during the cooling, the aimed microstructure cannot be obtained, and the SA (−20° C.) is low.

In the steel number 11, the CT is out of the range of the present invention, and therefore, enough effect of the precipitation strengthening cannot be obtained, and the tensile strength equivalent to X80 grade cannot be obtained as the material.

In the steel number 16, the C content is out of the range of the present invention, and therefore, the aimed microstructure cannot be obtained, and vE (−20° C.) is low.

In the steel number 17, the Nb content is out of the range of the present invention, and therefore, not only the enough effect of the precipitation strengthening cannot be obtained, and the tensile strength equivalent to X80 grade cannot be obtained as the material, but also the aimed microstructure cannot be obtained and the vE (−20° C.) is low because enough controlled rolling effect cannot be obtained.

In the steel number 18, the S/Ca is out of the range of claim 1 of the present invention, and therefore, the inclusion such as MnS becomes the starting point of the brittle fracture, and the SA (−20° C.) is low.

In the steel number 19, the Ti content is out of the range of the present invention, and therefore, the heated austenite grain size becomes coarse, the aimed microstructure cannot be obtained, and the SA (−20° C.) is low.

In the steel number 20, the N* is out of the range of the present invention, and therefore, the SA (−20° C.) is low.

In the steel number 21, the Mn content is out of the range of the present invention, and therefore, the SA (−20° C.) is low, the occurrence of the separation is remarkable, and the vE (−20° C.) is low.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

INDUSTRIAL APPLICABILITY

The present invention is able to be used for manufacturing of a hot-rolled steel sheet used for an electric resistance welded steel pipe and a spiral steel pipe in the steel industry. In particular, it is possible to use for manufacturing of a high-strength spiral linepipe having API5L-X80 standard or more in a sheet thickness of 16 mm or more also for the usage at the cold district where more severe fracture resistant property is required.

The invention claimed is:

1. A hot-rolled steel sheet, comprising by mass %:

C=0.02% to 0.06%;

Si=0.05% to 0.5%;

Mn=1% to 2%;

Nb=0.05% to 0.12%;

Ti=0.005% to 0.02%;

P≤0.03%;

S≤0.005%;

V≤0.003%;

Al=0.005% to 0.1%;

N=0.0015% to 0.006%;

Ca=0.0005% to 0.003%;

V 0.15% (0 (zero) % is not included);

Mo≤0.3% (0 (zero) % is not included)

N−14/48×Ti≥0 (zero) %; and the remaining portion made up of Fe and inevitable impurity elements, wherein a polygonal ferrite fraction is 3% or more and 20% or less, and the others are a low-temperature transformation phase and pearlite of 1% or less in a microstructure at a depth of a half thickness of a sheet thickness from a steel sheet surface, a number average crystal grain size of a whole of the microstructure is 1 μm or more and 2.5 μm or less, an area average grain size is 3 μm or more and 9 μm or less, a standard deviation of the area average grain size is 0.8 μm or more and 2.3 μm or less, and a reflected X-ray intensity ratio {211}/{111} in a {211} direction and in a {111} direction relative to a plane in parallel to the steel sheet surface at the depth of the half thickness of the sheet thickness from the steel sheet surface is 1.1 or more, and wherein the steel sheet has a strength of the API-X80 standard and a ductile fracture rate (SA) at −20° C. of 96% or more, and wherein the sheet thickness is 16 mm or more.

2. The hot-rolled steel sheet according to claim 1, wherein the hot-rolled steel sheet satisfies:

$$O<S/Ca<0.8.$$

3. The hot-rolled steel sheet according to claim 2, further comprising by mass %, one kind or two or more kinds from among:

Cr=0.05% to 0.3%;

Cu=0.05% to 0.3%;

Ni=0.05% to 0.3%;

B=0.0002% to 0.003%.

4. The hot-rolled steel sheet according to claim 3, further comprising by mass %:

REM=0.0005% to 0.02%.

5. The hot-rolled steel sheet according to any one of claims 1 to 4 wherein a maximum hardness at a central segregation portion of the hot-rolled steel sheet is 300 Hv or less, and a segregation band width of an average hardness of a base material+50 Hv or more is 200 μm or less.

* * * * *